US007891577B2

(12) United States Patent
Seki et al.

(10) Patent No.: US 7,891,577 B2
(45) Date of Patent: Feb. 22, 2011

(54) SAFETY DEVICE FOR A TRAIN

(75) Inventors: Masaki Seki, Yokohama (JP); Takashi Kachi, Nagoya (JP); Tomomi Funada, Shizuoka (JP); Takaaki Irie, Himeji (JP); Katsunari Konishi, Himeji (JP); Tetsuya Hanazaki, Himeji (JP)

(73) Assignees: Central Japan Railway Company, Nagoya-shi (JP); Yamato Trackwork System Co., Ltd., Himeji-shi (JP)

( * ) Notice: Subject to any disclaimer, the term of this patent is extended or adjusted under 35 U.S.C. 154(b) by 81 days.

(21) Appl. No.: 11/914,542

(22) PCT Filed: May 11, 2006

(86) PCT No.: PCT/JP2006/309463

§ 371 (c)(1),
(2), (4) Date: Jan. 19, 2009

(87) PCT Pub. No.: WO2006/123568

PCT Pub. Date: Nov. 23, 2006

(65) Prior Publication Data

US 2009/0200389 A1 Aug. 13, 2009

(30) Foreign Application Priority Data

May 16, 2005 (JP) ..... 2005-143107
May 16, 2005 (JP) ..... 2005-143126
May 23, 2005 (JP) ..... 2005-149384

(51) Int. Cl.
*E01B 5/18* (2006.01)

(52) U.S. Cl. ..... 238/18; 238/17; 238/19; 238/20; 238/21; 238/22; 104/242

(58) Field of Classification Search ..... 238/17, 238/18, 19, 20, 21, 22; 104/242
See application file for complete search history.

(56) References Cited

U.S. PATENT DOCUMENTS 992,968 A * 5/1911 Lynch ..... 238/17

(Continued)

FOREIGN PATENT DOCUMENTS

EP 0 402 351 A2 12/1990

(Continued)

OTHER PUBLICATIONS

International Search Report for PCT/JP2006/309463, dated Sep. 4, 2006.

(Continued)

*Primary Examiner*—S. Joseph Morano
*Assistant Examiner*—Jason C Smith
(74) *Attorney, Agent, or Firm*—Marshall, Gerstein & Borun LLP

(57) ABSTRACT

A derailment prevention guard includes a guard member (3) installed within a gauge and a support member (6) fixed to a sleeper (4) or a concrete slab track. The guard member (3) engages a hold member (8) moveable around an axis (7) supported by the support member (6) as turning center between a main rail (1) and the inside of the gauge on the sleeper. The support member (6) engages the hold member (8) by bolt (12) through turning the hold member (8) toward the main rail (1) around the central axis (7) as turning center on the sleeper (4), and the guard member (3) can be shunted inward by turning the hold member (8) toward the inside of the gauge around the central axis (7) as turning center on the sleeper (4) after loosening the bolt (12).

6 Claims, 31 Drawing Sheets

U.S. PATENT DOCUMENTS

| | | | | |
|---|---|---|---|---|
| 1,996,574 | A * | 4/1935 | Frazier | 238/8 |
| 2,110,818 | A * | 3/1938 | Peppin | 238/17 |
| 2,559,392 | A * | 7/1951 | Bone | 188/62 |
| 3,026,074 | A * | 3/1962 | Kern | 246/441 |
| 3,716,114 | A * | 2/1973 | Beck | 188/62 |
| 3,945,566 | A * | 3/1976 | Bush | 238/349 |
| 5,148,980 | A * | 9/1992 | Fritz et al. | 238/17 |
| 5,176,318 | A * | 1/1993 | Young et al. | 238/17 |
| 5,236,125 | A * | 8/1993 | Young et al. | 238/17 |
| 5,238,186 | A * | 8/1993 | Young et al. | 238/17 |
| 6,279,833 | B1 * | 8/2001 | Schwiede | 238/17 |
| 7,467,748 | B2 * | 12/2008 | Weaver et al. | 238/17 |
| 7,472,837 | B2 * | 1/2009 | Weaver et al. | 238/17 |
| 2007/0074639 | A1 * | 4/2007 | Weaver et al. | 104/242 |
| 2009/0200389 | A1 * | 8/2009 | Seki et al. | 238/18 |

FOREIGN PATENT DOCUMENTS

| | | | |
|---|---|---|---|
| EP | 1 342 846 | A2 | 9/2003 |
| JP | 03-137301 | | 6/1991 |
| JP | 09-071901 | A | 3/1997 |
| JP | 11-209902 | | 8/1999 |
| JP | 2003-239202 | | 8/2003 |
| SU | 1537732 | A1 | 1/1990 |

OTHER PUBLICATIONS

Supplementary European Search Report for EP 06 74 6272, dated Sep. 14, 2009.

* cited by examiner (a)

(b)

(a)

(b)

(c)

(a)

(b)

SAFETY DEVICE FOR A TRAIN

TECHNICAL FIELD

The present invention relates to a safety device for a train. In particular, the present invention relates to the device for guiding a wheel against running off a main rail and the device for preventing a derailed train from running away outside the track.

BACKGROUND ART

The present invention relates to the device being helpful to the safety running of the train. In particular, the present invention relates to a derailment prevention guard which guides a wheel against running off a main truck and a guard rail which prevents a derailed train from running away outside the track.

The outline of the derailment prevention guard and the guard rail will be described below. Further, the relation of the railway maintenance work, the derailment prevention guard and the guard rail will be described.

(1) The Derailment Prevention Guard

For example, when the train is running on the curved track, as shown in FIG. 26, it is generally conducted that a guard member, which guides a wheel 101 against running off a main rail 102, is arranged so as to be in parallel with the main rail 102 within the gauge. An example of derailment prevention structure comprising the guard member is shown in FIG. 27. In FIG. 27, a guard member 103 is arranged so as to be in parallel(being at right angles to a space) with the main rail 102, and the guard member 103 is fixed by tightening one set of a bolt 108 and a nut 109 and another set of a bolt 110 and a nut 111 through a block 104 and washers 105, 106 and 107. The guard member 103 is the derailment prevention guard. Although not shown, several sets of bolt-nut tightening structure are provided at right angles to a space.

(2) The Guard Rail

For example, when the train is running on the curved track, several guard rails are laid on the appropriate points to prevent a derailed train from running away outside the track and minimize damage from derailment even if the wheel 101 shown in FIG. 26 runs off the main rail 102. An example of the guard rail is shown in FIGS. 28(*a*)(*b*). As shown in FIG. 28(*a*), guard rails 113, 113 are installed inside the gauge of main rails 112, 112. In the place having frequent fall of rocks and snowfall or the other place needing the guard rail, guard rails 114, 114 are installed outside the main rails 112, 112, as shown in FIG. 28(*b*).

(3) The Railway Maintenance Work a. Track Bed Ballast Tamping by a Tie Tamper or a Multiple Tie Tamper For preventing the track sinking, as shown in FIG. 29(*a*), the ballast 116 around underneath rails 115, 115 to which the most weight of train is given is tamped so as to become densely by a track bed ballast tamping machine called a tie tamper or a multiple tie tamper, when the occasion demands. The ballast 117 except ballast underneath the rails 115, 115 is made so as to relatively become sparsely. The reason is as follows. The load in the vertical direction given through the rails is the maximum around underneath the rails, and if the filling density of ballast 116 around underneath the rails 115, 115 is nearly the same as the filling density of ballast 117 except ballast underneath the rails 115, 115, the ballast 116 around underneath the rails 115, 115 becomes sparsely by the large weight from the rails 115, 115 and a sleeper 118 at the spot sinks. As a result, the track sinking is caused.

In view of the foregoing, as shown in FIG. 29(*a*), for preventing the track sinking, the ballast 116 around underneath the rails 115, 115 to which the most weight of train is given is tamped so as to become densely by the tie tamper or the multiple tie tamper, and the ballast 117 except ballast underneath the rails 115, 115 is made so as to relatively become sparsely. The ballast 116 of a large filling density around underneath the rails 115, 115 carries the large weight from the rails 115, 115. Accordingly, the sleeper 118 does not sink.

But, as time goes by, as shown in FIG. 29(*b*), the large weight from the rails 115, 115 causes the filling density of ballast 116 around underneath the rails 115, 115 to become sparsely little by little. So, before the filling density of ballast become sparsely so as to cause the track sinking, as shown in FIG. 29(*a*), the ballast 116 around underneath the rails 115, 115 is tamped so as to become densely by the tie tamper or the multiple tie tamper.

b. Rail Grinding by a Rail Grinding Car

A rail grinding work by a rail grinding car is conducted to maintain the rails. This rail grinding work is conducted by a rail maintenance car and a rail grinding car. That is, the rail maintenance car carries a measuring device for evaluating objectively the comfortable degree to ride in by the data of magnitude of oscillation and direction of joggling of the train during running. The rail maintenance car runs on the rail at a predetermined interval(for example, a frequency of once or twice per year). If the data for evaluating the comfortable degree to ride in measured by the device exceeds a standard value, the rail grinding car grinds the unevenness part of rail so as to come up to the standard level while running on the corresponding rail. By the rail grinding work, since a value of magnitude of oscillation and direction of joggling of the train during running is limited within an appropriate range, a comfortable feeling to ride in can be obtained. The rail grinding work is conducted not only to the rail on the ballast track but also to the rail on the concrete slab track as shown in FIG. 30, if necessary. In FIG. 30, reference numeral 121 denotes a roadbed concrete, reference numeral 122 denotes a cement asphalt, reference numeral 123 denotes a concrete slab, and reference numeral 124 denotes a rail.

(4) The Relation Between the Range of Maintenance Work and the Derailment Prevention Guard or the Guard Rail FIG. 31 shows the range of maintenance work by a tie tamper to the arrangement of a main rail 131 and a derailment prevention guard member 132. The oblique line parts denote the range of maintenance work by the tie tamper. That is, since the construction on the oblique line parts interferes with the ballast tamping work by the tie tamper or the rail grinding work, the above construction must be moved to the location except the oblique line parts before the ballast tamping work or the rail grinding work. That is, the derailment prevention guard member 132 shown in FIG. 31 hinders the ballast tamping work by the tie tamper and the work by the rail grinding car or the rail maintenance car. However, since the conventional derailment prevention guard member has a tightening structure using many pairs of bolts and nuts, the tightening work and the loosening work take plenty of time and are complicated. Furthermore, in order to avoid the interference with the ballast tamping work by the tie tamper and the work by the rail grinding car or the rail maintenance car, the heavy derailment prevention guard member must be moved to the permanent wayside by human power. So, there is a possibility of the problem on safety during the movement.

Likewise, the guard rails 113, 114 shown in FIGS. 28(*a*)(*b*) hinder the ballast tamping work by the tie tamper and the rail grinding work. Accordingly, in order to avoid the interference with those works, the heavy guard rails must be moved to the permanent wayside by human power. So, there is a possibility of the problem on safety during the movement.

DISCLOSURE OF THE INVENTION

Problems to be Solved by the Invention

In view of the foregoing, the first object of the present invention is to provide a derailment prevention guard which is laid within a gauge and can be easily shunted outside the range of the ballast tamping work, the rail grinding work and the rail maintenance work, and has no problem on safety so that a guard member for guiding a wheel against running off the main rail will not interfere with the ballast tamping work or the works by a rail grinding car and a rail maintenance car.

The second object of the present invention is to provide a wheel guard device comprising a first function as a derailment prevention guard, which is laid within a gauge and can be easily shunted outside the range of the ballast tamping work, the rail grinding work and the rail maintenance work, and has no problem on safety so that a guard member for guiding a wheel against running off the main rail will not interfere with the ballast tamping work or the works by a rail grinding car and a rail maintenance car, and a second function as a guard rail, which can prevent a derailed train from running away outside the track even if the wheel runs off the main rail and is laid on the location being able to avoid the interference with the ballast tamping work or the works by the rail grinding car and the rail maintenance car.

The third object of the present invention is to provide a guard rail apparatus which can prevent a derailed train from running away outside the track even if a wheel runs off the main rail and is laid on the location being able to avoid the interference with the ballast tamping work.

Means for Solving the Problems

(1) The First Invention

For attaining the first object, a derailment prevention guard of the first invention comprises a guard member installed within a gauge and a support member fixed to a sleeper or a concrete slab track, and holds the guard member by a hold member which can turn around a central axis supported by the support member as turning center between a main rail and the inside of the gauge on the sleeper or the concrete slab track, and engages the support member with the hold member by means of an engaging member through turning the hold member toward the main rail around the central axis as turning center on the sleeper or the concrete slab track, and can shunt inward the guard member within the gauge by turning the hold member toward the inside of the gauge around the central axis as turning center on the sleeper or the concrete slab track after disengagement of the engaging member In accordance with the derailment prevention guard of the first invention, it has a structure of engaging the support member with the hold member by the engaging member by turning the hold member holding the guard member toward the main rail around the central axis supported by the support member as turning center on the sleeper or the concrete slab track, and turning the holding member toward the inside of the gauge around the central axis as turning center on the sleeper or the concrete slab track after disengagement of the engaging member. Accordingly, the guard of the main rail by the guard member and the inward shunt of the guard member within the gauge can be easily conducted by engagement and disengagement of the engaging member. Furthermore, in the shunt of the guard member, it is not necessary to move the heavy guard member to the permanent wayside by human power.

If the hold member is provided with a wire spring as hold means for holding the guard member, preferably the guard member can be held so as to be freely engaged and disengaged by spring action of the wire spring.

The wire spring comprises a first straight connecting portion and a second straight connecting portion. Furthermore, preferably the wire spring comprises the following constitution: The first straight connecting portion extends from a first hook-shaped portion at one end. The second straight connecting portion extends from a second hook-shaped portion at the other end. The first straight connecting portion is approximately in parallel with the second straight connecting portion in sight of plane. Both the first straight connecting portion and the second straight connecting portion are connected to a straight pushing down portion via a connecting portion looking like the Japanese cursive character "<" (pronounced 'ku'). The connecting portion looking like the Japanese cursive character "<" comprises an outward obliquely upward extending lower portion looking like the Japanese cursive character "<" and an inward obliquely upward extending upper portion looking like the Japanese cursive character "<". Both lower portions looking like Japanese cursive character are connected to the first and second straight connecting portions. Both upper portions looking like the Japanese cursive character "<" are connected to the straight pushing down portion. So, if the first hook-shaped portion and the second hook-shaped portion are pushed down, the guard member can be held by the spring power caused by pushing down. If the first straight connecting portion and the second straight connecting portion are stretched outward, the above spring power can be released. Thus, the engagement and disengagement of the wire spring with the guard member can be easily conducted.

The Second Invention

For attaining the second object, a wheel guard device of the second invention comprises a protection rail installed inside or outside a gauge and a support member fixed to a sleeper or a concrete slab track, and holds the protection rail by a hold member which can turn around a central axis supported by the support member as turning center between a main rail and the inside or the outside of the gauge on the sleeper or the concrete slab track, and engages the support member with the hold member by means of an engaging member which is inserted into and passes through penetration holes provided at the support member and the hold member through turning the hold member toward the main rail around the central axis as turning center on the sleeper or the concrete slab track, and can shunt the protection rail inward or outward of the gauge by turning the hold member toward the inside or the outside of the gauge around the central axis as turning center on the sleeper or the concrete slab track after disengagement of the engaging member by pulling out from the penetration holes, wherein the main rail and the protection rail are curved and the central axis can move along the inside of long slots provided at the support member and the hold member in the direction of the gauge.

As shown in FIG. 8, if main rails 21*a*, 21*b* and a protection rail(guard rail) 22 are curved, each distance from central axes 23*a*, 24*a* and 25*a* which are turning centers corresponding to hold members 23, 24 and 25 holding the protection rail(guard rail) 22 to the protection rail(guard rail) 22 differs one another. Accordingly, if each central axis of hold members 23, 24 and 25 is fixed(unmovable), it is impossible to turn the protection rail(guard rail) 22. A common central axis for forming line symmetry is necessary to turn the curved protection rail(guard rail) 22 to two dotted line 22*a* being inside of gauge. In this case, if hold members of many kinds may be used and each central axis of the hold members coincides with an imaginary central axis 26 of the common central axis, it is possible to hold the protection rail(guard rail) 22 by many hold members and turn the protection rail(guard rail) 22 around the imaginary central axis 26 as turning center to the inside of the gauge. But, the many kinds of hold members having different central axes are needed and the production cost is remarkably raised.

In accordance with the wheel guard device of the second invention, in FIG. 8, the central axes 23*a*, 24*a* and 25*a* can move along the inside of long slots provided at the support member and the hold member in the direction of the gauge. So, the central axes 23*a*, 24*a* and 25*a* are moved to the location coinciding with the imaginary central axis 26, and the protection rail(guard rail) 22 is held by the hold members 23, 24 and 25, and the support members are engaged with the hold members by means of an engaging member which is inserted into and passes through the penetration holes provided at the support members and the hold members through turning the hold members toward the main rail around the imaginary central axis 26 as turning center on a sleeper 27, and the protection rail(guard rail) can be easily shunted inward within the gauge by turning the hold members 23, 24 and 25 holding the protection rail(guard rail) 22 toward the inside of the gauge around the imaginary central axis 26 as turning center on the sleeper 27 after disengagement of the engaging member by pulling out from the penetration holes. In case of the shunt of the protection rail(guard rail), it is not necessary to move the heavy protection rail(guard rail) to the permanent wayside by human power.

The Third Invention

For attaining the third object, a guard rail apparatus of the third invention guide derailed wheels by a guard rail installed within a gauge so that a derailed train will not run away outside the track, wherein, in the middle of the gauge being outside the range of the ballast tamping work, a first guard rail is arranged so as to be in parallel with one main rail so that the first guard rail may face one main rail keeping the rail head oblique, and a second guard rail is arranged so as to be in parallel with the other main rail so that the second guard rail may face the other main rail keeping the rail head oblique, and the first guard rail and the second guard rail are fastened to a sleeper or a concrete slab track by a rail fastening device. For attaining the third object, in place of the above constitution, the following guard rail apparatus may be used. The guard rail apparatus guide derailed wheels by a guard rail installed on the edge of a sleeper or a concrete slab track so that a derailed train will not run away outside the track, wherein a first guard rail and a second guard rail are arranged so as to be in parallel with a main rail at the locations being outside the range of the ballast tamping work at one end and the other end of the sleeper or the concrete slab track respectively, and the first guard rail and the second guard rail are fastened to the sleeper or the concrete slab track by a rail fastening device.

In accordance with the guard rail apparatus of the third invention, even if the wheel runs off the main rail due to inevitable circumstances, the movement to the direction of the gauge by the derailed wheel is blocked through striking the first guard rail head or the second guard rail head, and the derailed train will not run away outside the track. Furthermore, the movement to the direction of the gauge by the derailed wheel is blocked by the first guard rail and the second guard rail being located outside the range of the ballast tamping work, and there is no work of installation and disinstallation or movement of the guard rail. As a result, the maintenance work is not needed and high safety can be guaranteed.

A rail fastening device for fastening a guard rail installed on the edge of a sleeper or a concrete slab track to the sleeper or the concrete slab track can adopt the following fastening structure. The rail fastening device comprises a fixed block and a first fixed metal fitting and a second fixed metal fitting. The upper surface of the sleeper or the concrete slab track slopes a little upward from the center toward both ends. The fixed block comprises a pseudowedge-shaped projection along the slope of the upper surface of the sleeper or the concrete slab track and a plate-shaped member being able to come into contact with the edge face of the sleeper or the concrete slab track. The first fixed metal fitting comprises a left side member, a right side member and a bottom member. An upward projection is provided around the edge of the bottom member. The pseudowedge-shaped projection of the fixed block is touched to the slope of the upper surface of the sleeper or the concrete slab track. The bottom member of the first fixed metal fitting is touched to the lower surface of the sleeper or the concrete slab track, and the both sides of the sleeper or the concrete slab track are covered with the left side member and the right side member. The pseudowedge-shaped projection of the fixed block is pushed down by the second fixed metal fitting, and the pseudowedge-shaped projection of the fixed block is put between the second fixed metal fitting, the left side member and the right side member of the first fixed metal fitting, and the sleeper or the concrete slab track is fastened by a fastening member. The plate-shaped member of the fixed block is received in a gap between the projection provided at the bottom member of the first fixed metal fitting and the end face of the sleeper or the concrete slab track. One rail base end of the guard rail is received at a recess of the fixed block and the other rail base of the guard rail is fastened by a fastening member.

Thus, it is possible to install the guard rail apparatus without processing the present sleeper or concrete slab track. Especially, the pseudowedge-shaped projection along the slope of the upper surface of the sleeper or the concrete slab track is put between the first fixed metal fitting and the second fixed metal fitting, and the sleeper or the concrete slab track is fastened so as to be just wrapped in the fixed block, the first fixed metal fitting and the second fixed metal fitting. As a result, the rail fastening device is hard to release from the sleeper or the concrete slab track.

The plate-shaped member of the fixed block is sandwiched in between the projection of the first fixed metal fitting and the end face of the sleeper or the concrete slab track. As a result, the fixed block, the first fixed metal fitting and the sleeper or the concrete slab track make a movement so as to be just incorporated in one structure and it is possible to minimize clattering of the rail fastening device.

EFFECTS OF THE INVENTION

Since the present inventions have the above constitutions, the following effects can be achieved.

(1) In accordance with the first invention, it is possible to provide a derailment prevention guard which can be easily shunted outside the range of the ballast tamping work, the rail grinding work and the rail maintenance work, and has no problem on safety so that a guard member for guiding a wheel against running off the main rail will not interfere with the ballast tamping work by a tie tamper or the works by a rail grinding car and a rail maintenance car.

(2) In accordance with the second invention, it is possible to provide a wheel guard device which can be easily shunted outside the range of the ballast tamping work, the rail grinding work and the rail maintenance work, and has no problem on safety so that a protection rail for guiding a wheel against running off main rail or a guard rail for guiding a derailed wheel against the derailed train from running away outside the track will not interfere with the ballast tamping work by a tie tamper or the works by a rail grinding car and a rail maintenance car.

(3) In accordance with the third invention, it is possible to provide a guard rail which can prevent a derailed train from running away outside the track even if a wheel runs off the main rail and is laid on the location being able to avoid the interference with the ballast tamping work by a tie tamper.

EXPLANATION OF REFERENCE NUMERALS

Figure 1:
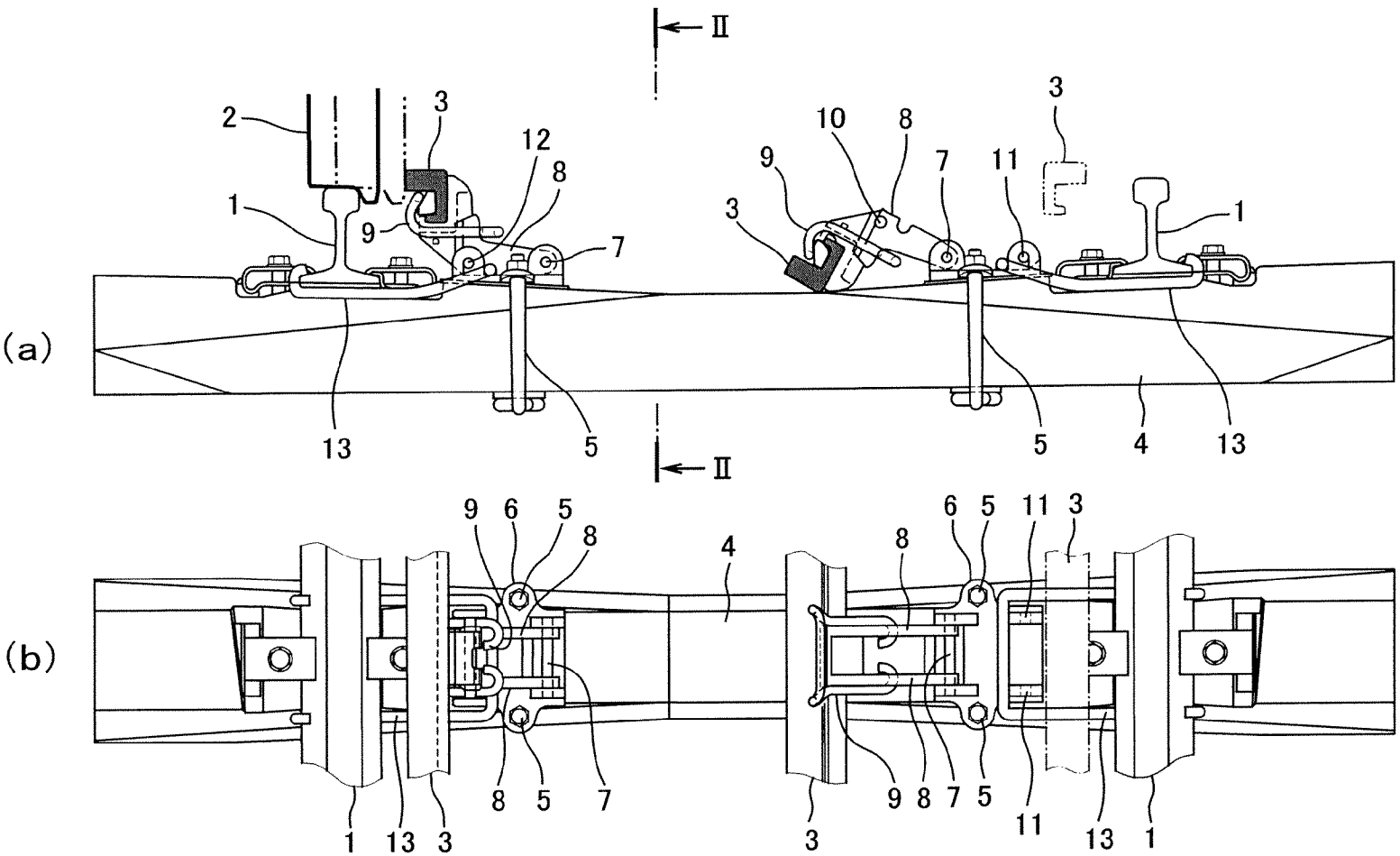
FIG. 1(*a*) is a side view of the first embodiment of a structure of a derailment prevention guard of the first invention applied to a permanent way, and FIG. 1(*b*) is a plane view of FIG. 1(*a*).

1 main rail
2 wheel
3 guard member
4 sleeper
5 bolt
6 support member
7 central axis
8 hold member
9 spring member(wire spring)
10 penetration hole
11 penetration hole
12 bolt
13 spring member
14*a* first hook-shaped portion
14*b* second hook-shaped portion
15*a* first straight connecting portion
15*b* second straight connecting portion
16 connecting portion looking like the Japanese cursive character "<"
16*a* lower portion looking like the Japanese cursive character "<"
16*b* upper portion looking like the Japanese cursive character "<"

17 straight pushing down portion
18*a*, 18*b* circular sloped and projected surface
19*a*, 19*b* constricted part
20*a*, 20*b* projection
P trapezoid-shaped member in section
RC roadbed concrete
CA cement asphalt
CS concrete slab
21*a* main rail
21*b* main rail
22 protection rail
23 hold member
24 hold member
25 hold member
23*a* central axis
24*a* central axis
25*a* central axis
26 imaginary central axis
27 sleeper
28 main rail
29 wheel
30 protection rail
31 sleeper
32 hook
33 bolt
34 support member
35 central axis
36 long slot
37 hold member
38 long slot
39 penetration hole
40 penetration hole
41 bolt(engaging member)
42 trapezoid-shaped member
43 projection of hold member
44 bolt
45 nut
46 radius of curvature
47 arc
48 chord
50 roadbed concrete
51 cement asphalt
52 concrete slab
61*a* main rail
61*b* main rail
62*a* wheel
62*b* wheel
63 first guard rail
63*a* rail head
63*b* rail base
64 second guard rail
64*a* rail head
64*b* rail base
65 prestressed concrete sleeper
66 flat plate
67 bolt
68 washer
69 washer
70 washer
71 bolt
73 range of ballast tamping work
74 rail fastening device
75 fixed block
76 first fixed metal fitting
77 second fixed metal fitting
78 washer
79 plate-shaped member
80 projection
81 pseudowedge-shaped projection
82 left side member
83 right side member
84 bottom member
85 bolt hole
86 bolt hole
87 bolt
89 recess
90 wire spring clip
91 receiving metal fitting
92 opening
93 roadbed concrete
94 cement asphalt
95 concrete slab

BEST MODE FOR CARRYING OUT THE INVENTION

The embodiments of the present invention will be described below with reference to the drawings. The extent of the present invention should not be limited to the embodiments below, and it is easily understood to one skilled in the art that it would be revised or modified without departing from the extent of the present invention.

1. Embodiments of the First Invention

The First Embodiment

FIG. 1(*a*) is a side view of the first embodiment of a structure of a derailment prevention guard of the first invention applied to a permanent way(ballast bed track), and FIG. 1(*b*) is a plane view of FIG. 1(*a*).

In FIGS. 1(*a*)(*b*), reference numeral 1, 1 are main rails, and reference numeral 2 is a wheel. Guard members 3 are installed within the gauge so as to be in parallel with the main rails 1, 1.

A support member 6 is fixed to a sleeper 4 by a bolt 5. The guard member 3 is held by a spring member 9 attached to a hold member 8 which can turn around a central axis 7 supported by the support member 6 as turning center between the main rail 1 and the inside of the gauge on the sleeper 4(The structure and function of the spring member 9 will be described below).

The guard member 3 is in parallel with the main rail 1 by turning the hold member 8 toward the main rail 1 around the central axis 7 as turning center on the sleeper 4, and the support member 6 is engaged with the hold member 8 through a bolt 12 by inserting the bolt (engaging member) 12 into a penetration hole 10 provided at the hold member 8 and a penetration hole 11 provided at the support member 6, and making the bolt 12 passing through the penetration holes 10, 11, and tightening the bolt 12 with a nut(See left halves of FIGS. 1(*a*) and 1(*b*)).

After loosening the bolt 12 with the nut, the guard member 3 can shunted inward within the gauge by turning the hold member 8 toward the inside of the gauge around the central axis 7 as turning center on the sleeper 4(See right halves of FIGS. 1(*a*) and 1(*b*)).

Reference numeral 13 is a spring member for fastening tightly the hold member 6 to the main rail 1.

Figure 2:
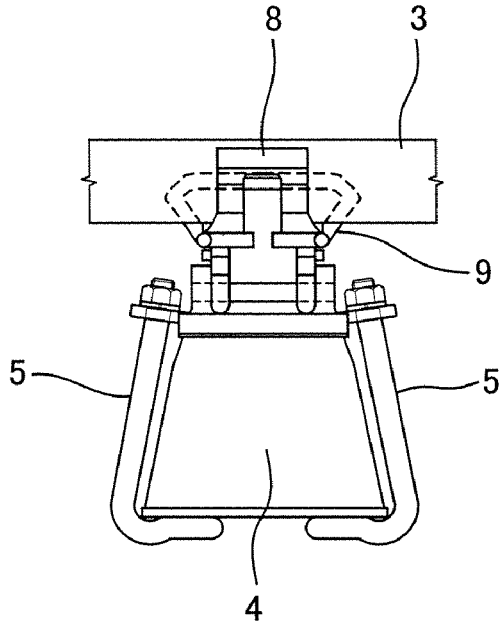
FIG. 2 is a sectional view in the direction of arrow mark II-II drawn in FIG. 1 (*a*). The main rail and the wheel are omitted.

FIG. 2 is a sectional view in the direction of arrow mark II-II drawn in FIG. 1 (*a*), and the main rail 1 and the wheel 2 are omitted.

Figure 3:
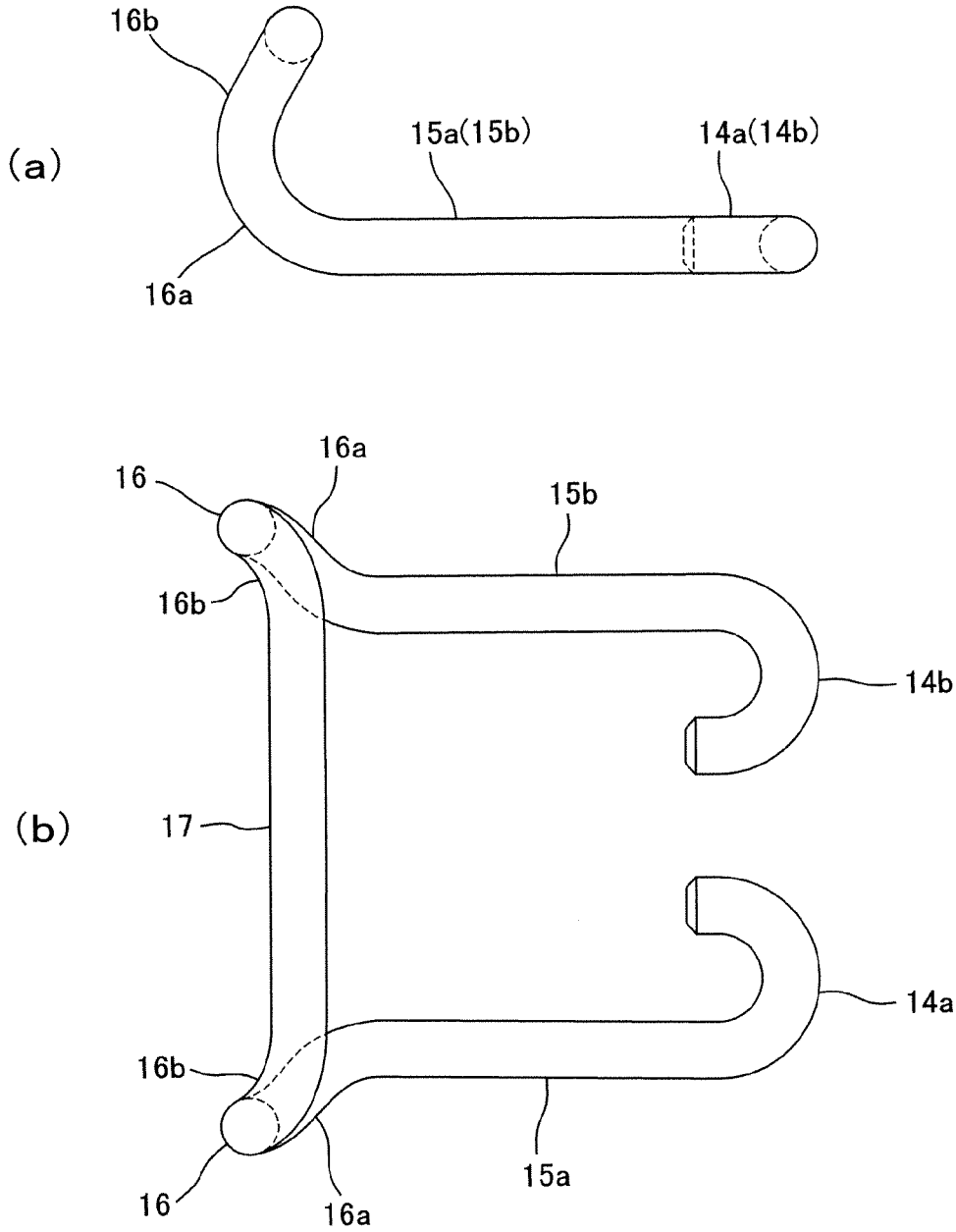
FIG. 3(*a*) is a side view of a wire spring 9, and FIG. 3(*b*) is a plane view of a wire spring 9.

FIG. 3(*a*) is a side view of a spring member(wire spring) 9, and FIG. 3(*b*) is a plane view of the wire spring 9.

In FIGS. 3(*a*) and 3(*b*), the wire spring 9 comprises a first straight connecting portion 15*a* extending from a first hook-shaped portion 14*a* at one end and a second straight connecting portion 15*b* extending from a second hook-shaped portion 14*b* at the other end. The first straight connecting portion 15*a* is approximately in parallel with the second straight connecting portion 15*b* in sight of plane. Both the first straight connecting portion 15*a* and the second straight connecting portion 15*b* are connected to a straight pushing down portion 17 via a connecting portion 16 looking like the Japanese cursive character "<". The connecting portion 16 looking like the Japanese cursive character "<" comprises an outward obliquely upward extending lower portion 16*a* looking like the Japanese cursive character "<" and an inward obliquely upward extending upper portion 16*b* looking like the Japanese cursive character "<". Both lower portions 16a looking like the Japanese cursive character "<" are connected to the first and second straight connecting portions 15*a*, 15*b*. Both upper portions 16*b* looking like the Japanese cursive character "<"are connected to the straight pushing down portion 17.

Figure 4:
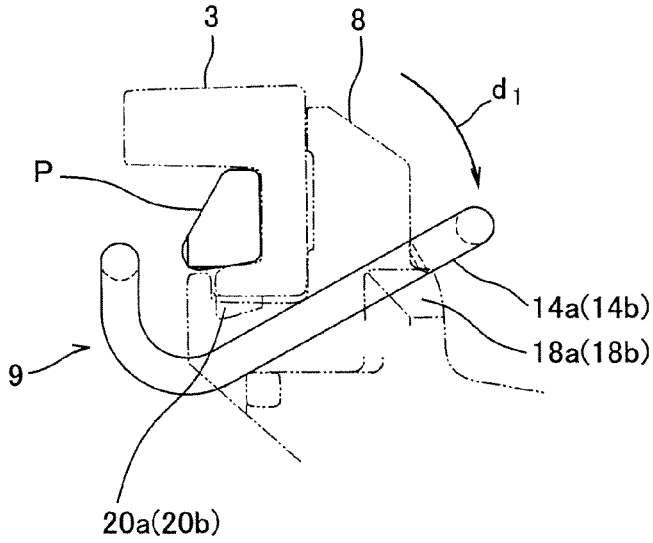
FIGS. 4(*a*) and 4(*b*) are views for illustrating a process of attaching a wire spring 9 to a hold member 8.
Figure 4:
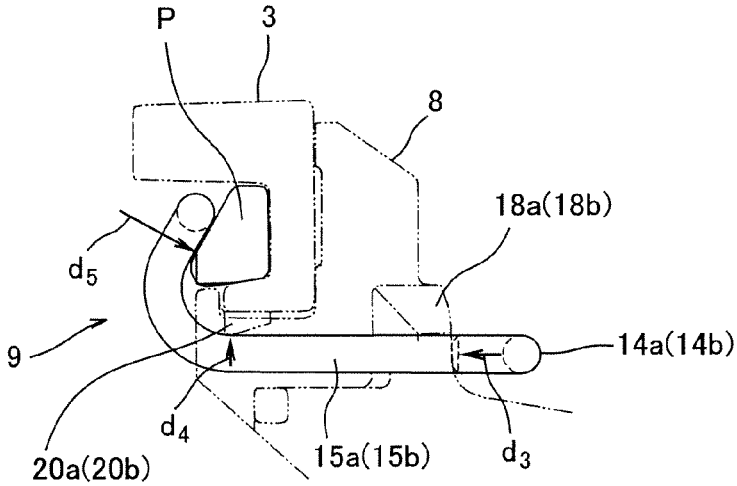

FIGS. 4(*a*) and 4(*b*) are views for illustrating a process of attaching the wire spring 9 to the hold member 8. As shown in FIG. 4(*a*), if the first hook-shaped portion 14*a* and the second hook-shaped portion 14*b* are pushed down as shown in arrow mark d1 and the wire spring 9 is turned, as shown in FIG. 6, the first straight connecting portion 15*a* and the second straight connecting portion 15*b* of the wire spring 9 stretch outward along circular sloped and projected surfaces 18*a*, 18*b* of the hold member 8, and get over the circular sloped and projected surfaces 18*a*, 18*b* respectively. And the first straight connecting portion 15*a* and the second straight connecting portion 15*b* are received at constricted parts 19*a*, 19*b* directly below the circular sloped and projected surfaces 18*a*, 18*b* respectively. That is, as shown in FIG. 4(*b*), the edges of the hold members 8 are pushed against by the first hook-shaped portion 14*a* and the second hook-shaped portion 14*b* of the wire spring 9 (see FIG. 5), and the first straight connecting portion 15*a* and the second straight connecting portion 15*b* are blocked by projections 20*a* and 20*b* respectively (see FIG. 5), and the guard member 3 can be pushed against the hold member 8 via a trapezoid-shaped member P in section by the straight pushing down portion 17 (see FIG. 5). Thus, the guard member 3 can be held. The trapezoid-shaped member P is tightly fixed to the guard member 3.

Figure 5:
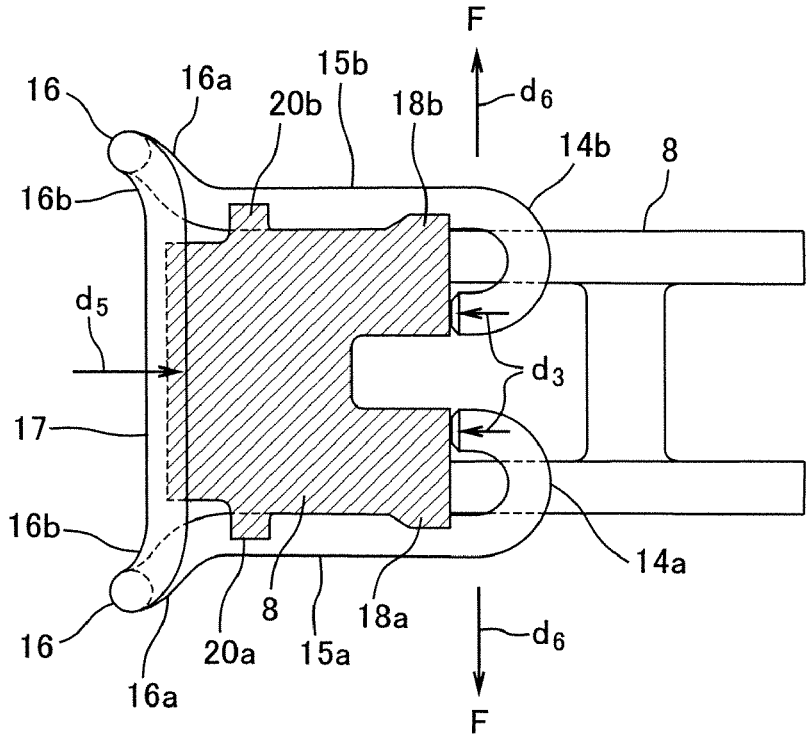
FIG. 5 is a view of the appearance of the members after a wire spring 9 was attached to a hold member 8.
Figure 6:
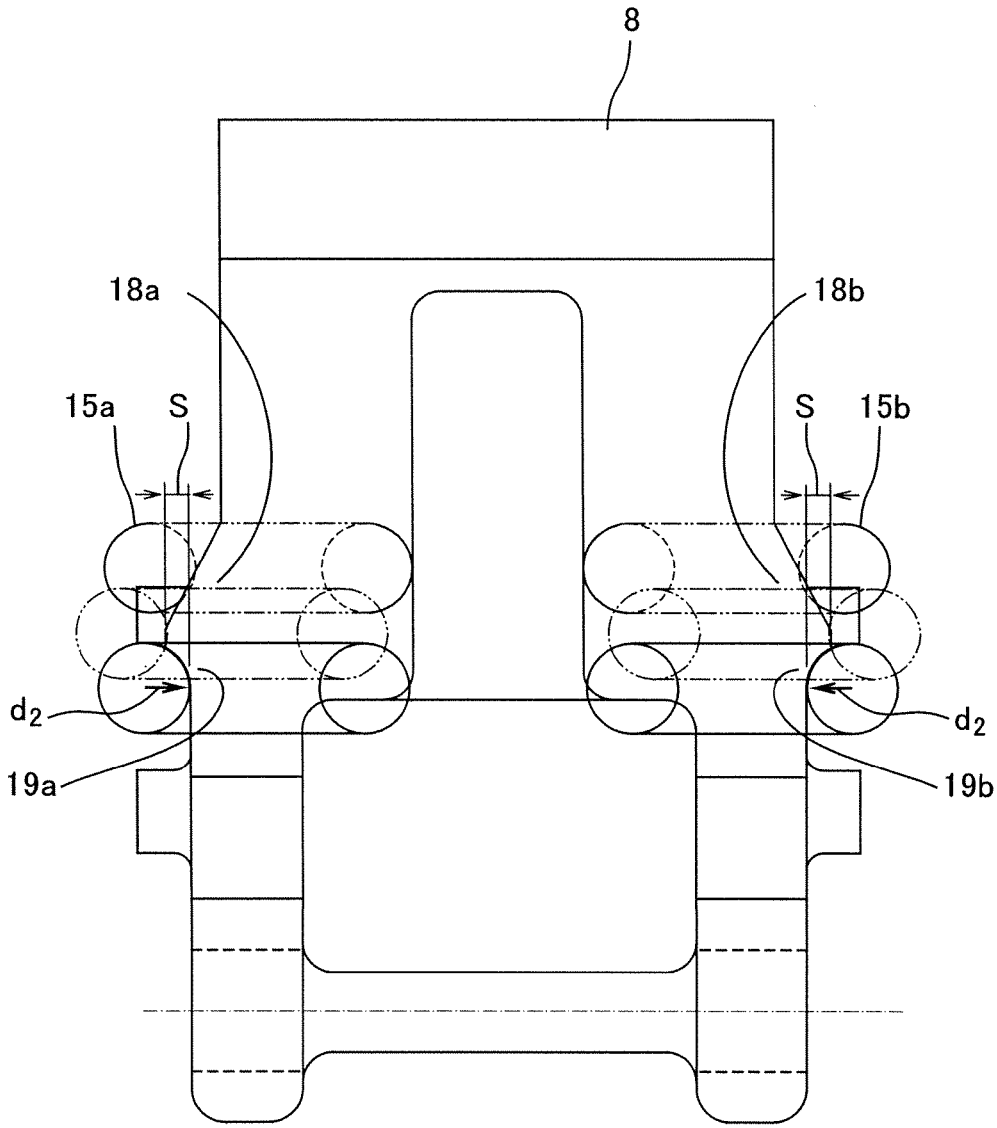
FIG. 6 is a view for illustrating a process of attaching a wire spring 9 to a hold member 8.

In order to detach the wire spring 9, as shown in FIG. 6, the first straight connecting portion 15*a* and the second straight connecting portion 15*b* of the wire spring 9 are transferred to the circular sloped and projected surfaces 18*a*, 18*b* of the hold member 8 and the restraint by the constricted parts 19*a* and 19*b* is released by stretching outward the first straight connecting portion 15*a* and the second straight connecting portion 15*b* by the dimension "S" respectively(see FIG. 6), as shown in arrow mark d6 of FIG. 5. As a result, all of the above spring forces are removed and the engagement of the wire spring 9 with the guard member 3 is released, as shown in FIG. 4(*a*).

As clearly shown by the above detailed description, the attachment and detachment of the wire spring 9 can be easily conducted by pushing down the first hook-shaped portion 14*a* and the second hook-shaped portion 14*b* or stretching outward the first straight connecting portion 15*a* and the second straight connecting portion 15*b*.

(The Derailment Prevention Function)

In accordance with the derailment prevention guard as described above, as shown in FIG. 1(*a*), if the wheel 2 of the train running on the main rail is likely to derail, the transverse movement of the wheel 2 is blocked by the derailment prevention guard 3 and the wheel 2 being likely to derail is returned to the main rail 1 so as to be attendant on the wheel running normally on the main rail 1. As a result, the wheel 2 does not derail. The derailment prevention guard does not need the function to push positively against the wheel, and the function as a resistance substance for suppressing the transverse movement of the wheel is enough for the derailment prevention guard.

The Second Embodiment

Figure 7:
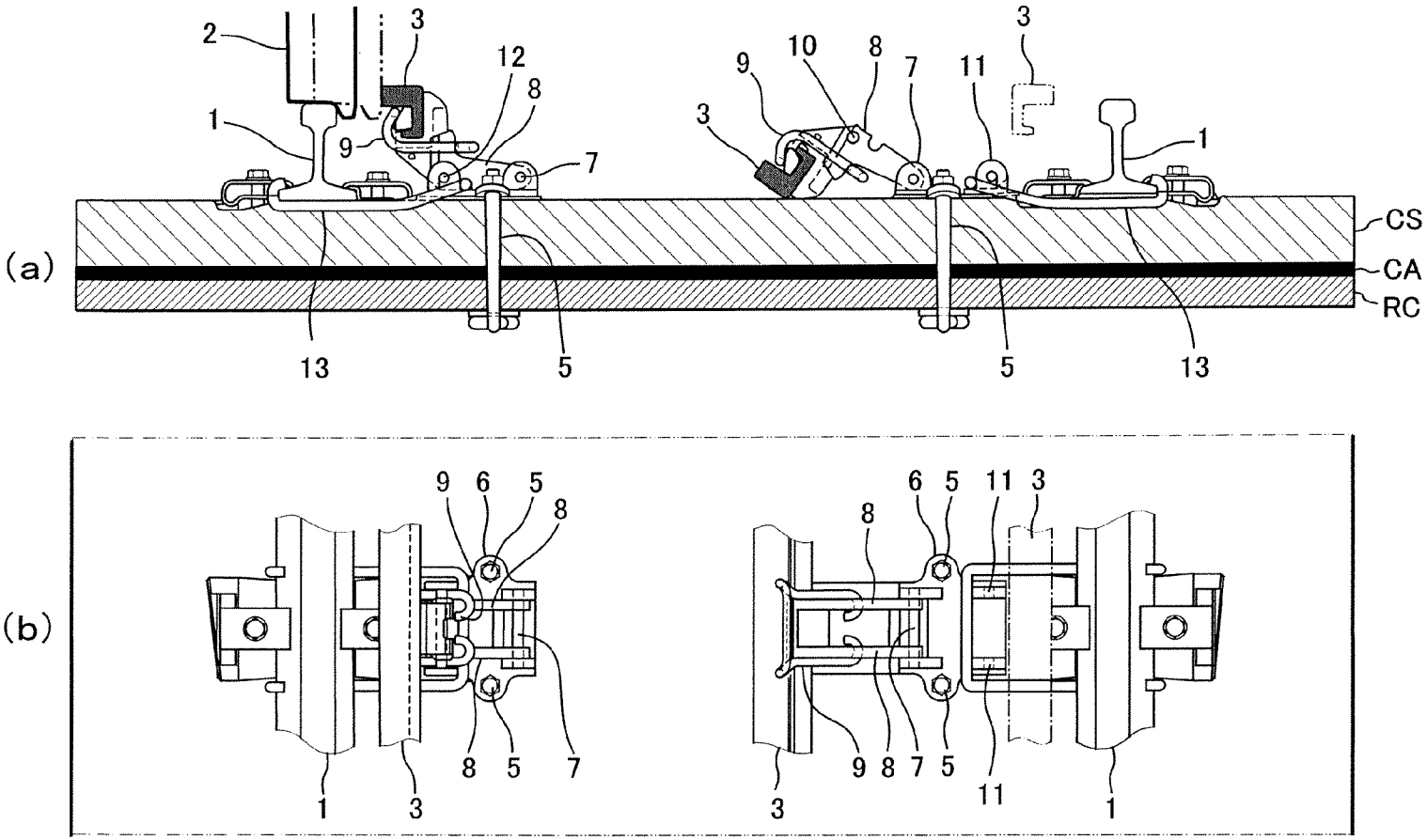
FIG. 7(*a*) is a side view including a section of the second embodiment of a structure of a derailment prevention guard of the first invention applied to a permanent way, and FIG. 7(*b*) is a plane view of FIG. 7(*a*).

FIG. 7(*a*) is a side view including a section of the second embodiment of a structure of a derailment prevention guard of the first invention applied to a permanent way (concrete slab track), and FIG. 7(*b*) is a plane view of FIG. 7(*a*). FIG. 7(*a*)(*b*) is different from FIG. 1 in that a concrete slab track comprising a roadbed concrete RC, a cement asphalt CA and a concrete slab CS is used in place of the sleeper 4. Accordingly, the process of attaching the wire spring 9 to the hold member 8 and the process of detaching thereof is the same as described above. The explanation of the other members is omitted by giving the identical reference numerals as FIG. 1.

(Ballast Tamping Work or Rail Grinding Work Underneath Rail and the Derailment Prevention Guard of the First Invention)

Figure 29:
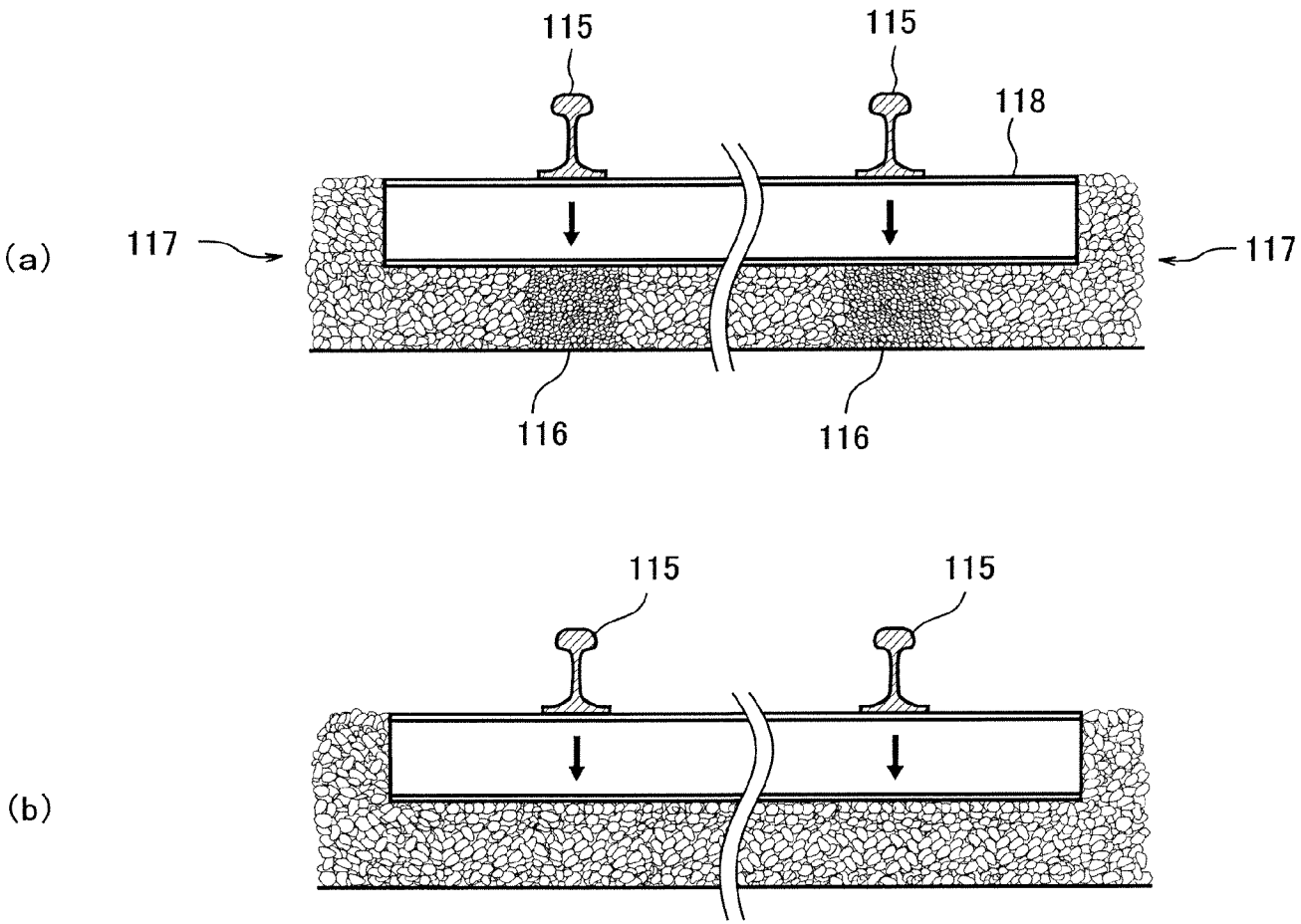
FIGS. 29(*a*) and (*b*) are views for illustrating an example of dense and sparse situations of ballast around underneath a rail and thereabouts.
Figure 30:
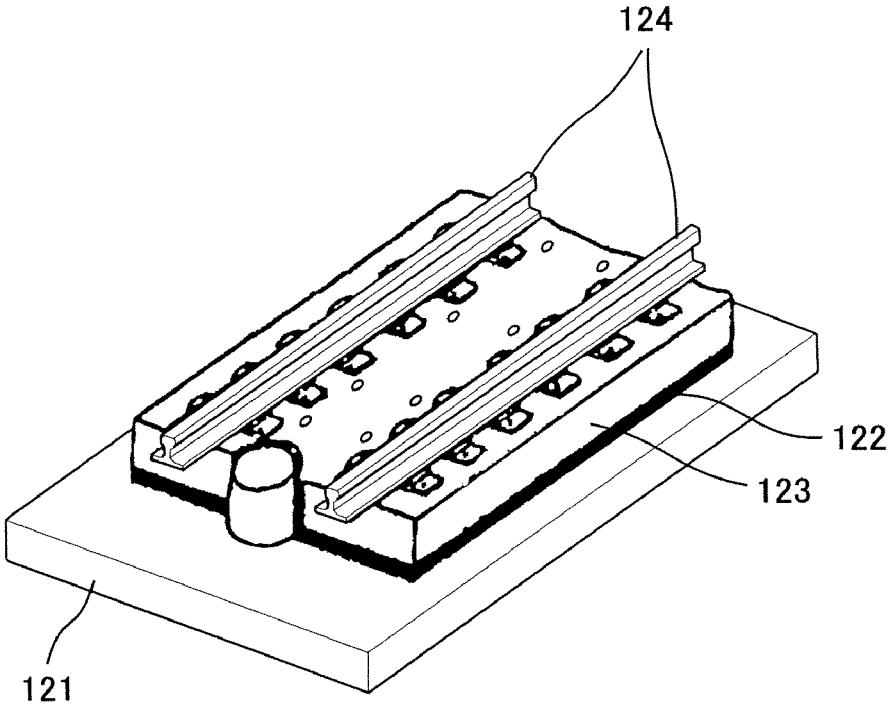
FIG. 30 is a perspective view of an example of a concrete slab track.
Figure 31:
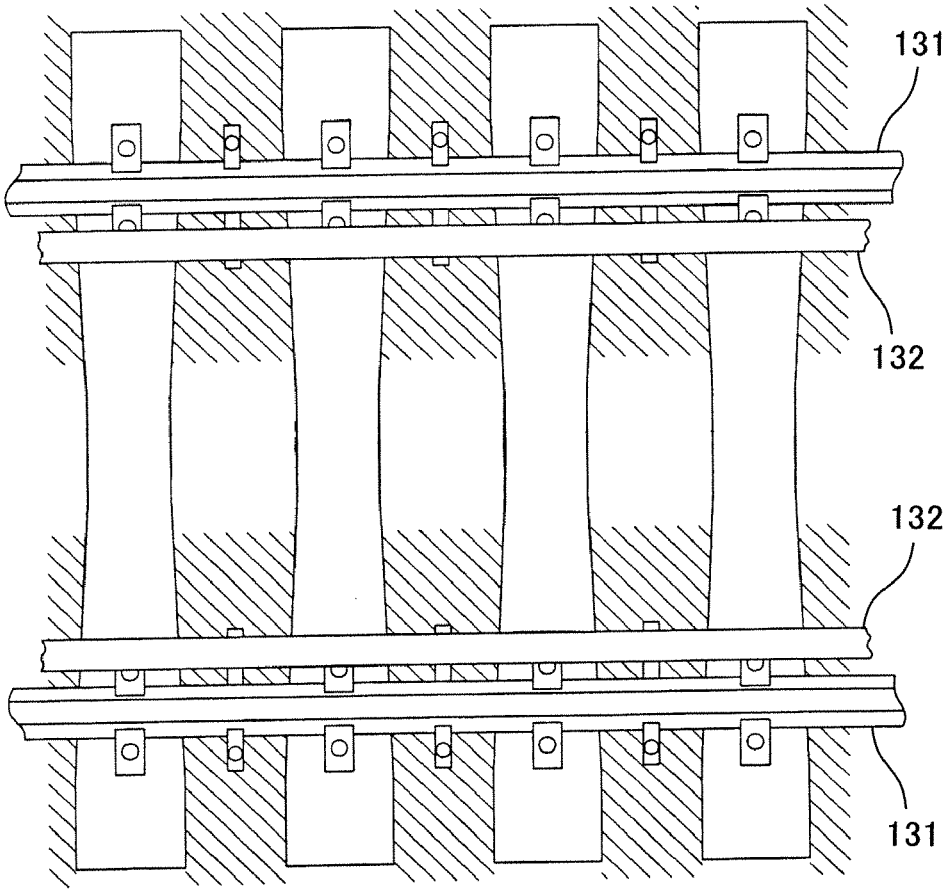
FIG. 31 is a view showing a range of maintenance work by a tie tamper to an arrangement of a main rail and a derailment prevention guard member.

As shown in FIG. 29(*b*), the large weight from rails causes the filling density of ballasts around underneath the rails to become sparsely little by little. So, before the filling density of ballasts become sparsely so as to cause track sinking, as shown in FIG. 29(*a*), the ballasts around underneath the rails needs to be tamped so as to become densely by a tie tamper or a multiple tie tamper. If the rail maintenance car runs on a rail and the data for evaluating the comfortable degree to ride in exceeds a standard value, the rail grinding car must grind the unevenness part of the rail. In this case, by the present invention, if the bolt 12 shown in FIGS. 1(*a*)(*b*), which engages the support member 6 with the hold member 8, is loosened, as shown in right halves of FIGS. 1(*a*)(*b*) or FIGS. 7(*a*)(*b*), the guard member 3 can be shunted inward within the gauge by turning the hold member 8 toward the inside of the gauge around the central axis 7 as turning center on the sleeper 4 or the concrete slab track. Accordingly, the guard member 3 does not interfere with the ballast tamping work underneath the main rail 1 by a tie tamper or a multiple tie tamper and the works of the rail grinding car and the rail maintenance car. It is not necessary to move the heavy guard member to the permanent wayside outside the range of the ballast tamping work, the rail grinding work and the rail maintenance work by human power. So, there is no problem on safety.

2. Embodiments of the Second Invention

The First Embodiment

Figure 9:
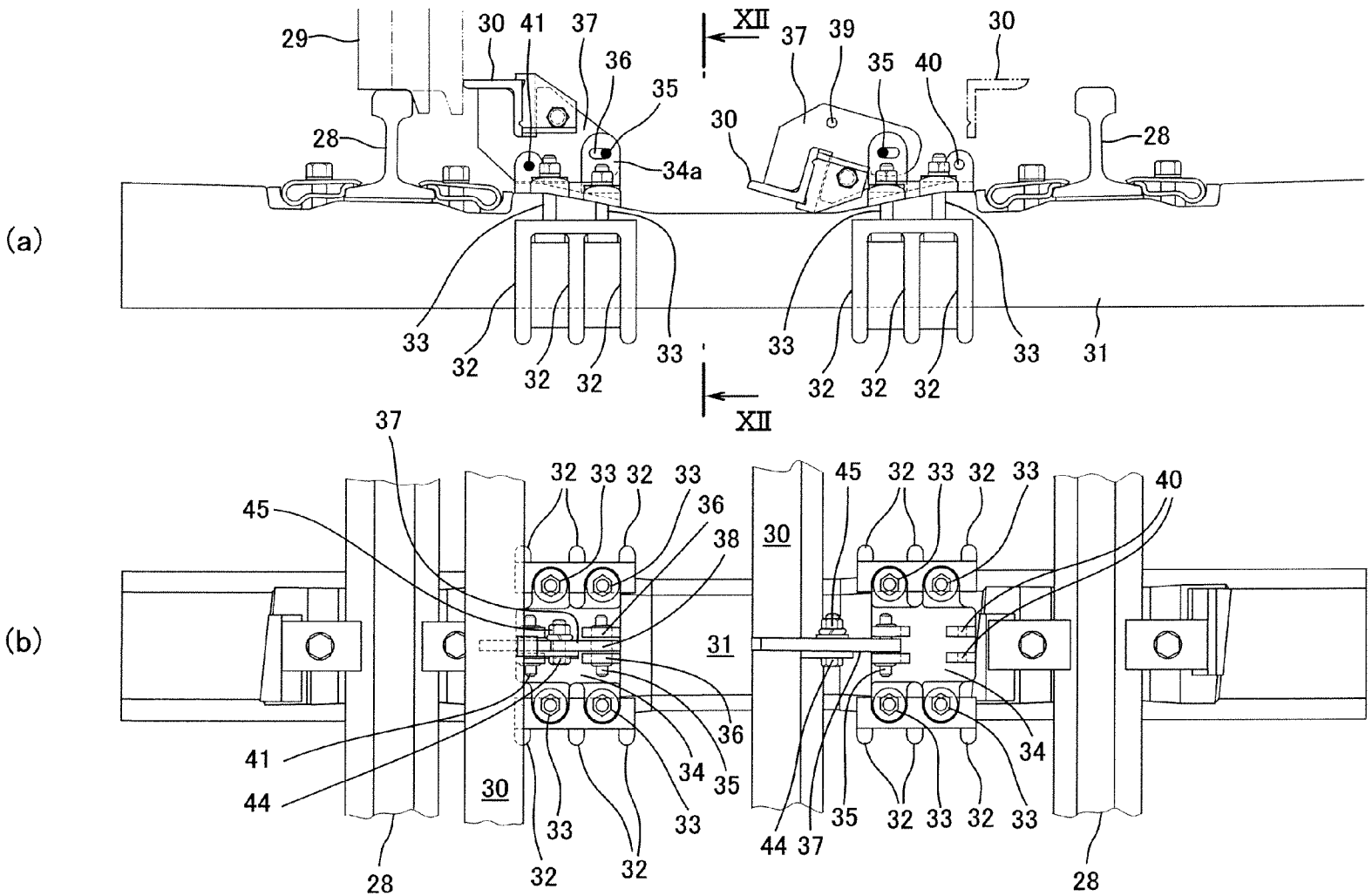
FIG. 9(*a*) is a side view of the first embodiment of a structure of a derailment prevention guard of the second invention applied to a permanent way, and FIG. 9(*b*) is a plane view of FIG. 9(*a*).

FIG. 9(*a*) is a side view of the first embodiment of a structure of a wheel guard device of the second invention as a derailment prevention guard applied to a permanent way (ballast bed track), and FIG. 9(*b*) is a plane view of FIG. 9(*a*). In FIGS. 9(*a*)(*b*), reference numerals 28, 28 are main rails, and reference numeral 29 is a wheel. Protection rails 30, 30 are installed within the gauge so as to be in parallel with the main rails 28, 28.

A support member 34 is fixed to a sleeper 31 by a hook 32 and a bolt 33. A member 34*a*, which is projected from a support member 34, is provided with a long slot 36 in the direction of the gauge, along the inside of which a central axis 35 can move. A hold member 37, which holds the protection rail 30, is provided with a long slot 38 in the direction of the gauge, along the inside of which a central axis 35 can move. In a plane sight, the location in the longitudinal direction of the long slot 36 is identical with the one of the long slot 38. The hold member 37 can turn around the central axis 35 as turning center between the main rail and the inside of the gauge on the sleeper 31. The hold member 37 and the support member 34 are provided with penetration holes 39 and 40 respectively for inserting a bolt 41.

Figure 8:
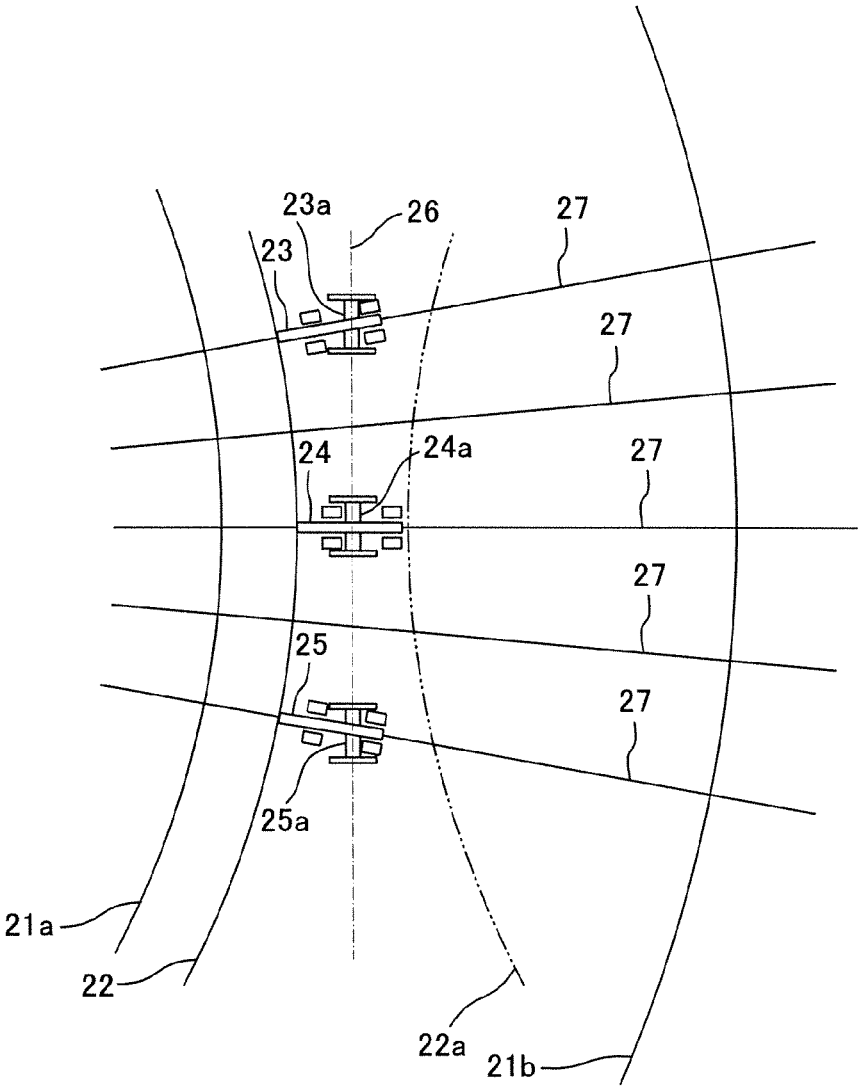
FIG. 8 is a view for illustrating a function of a derailment prevention guard of the second invention.

Generally, in many cases, one protection rail may be held by three to five hold members. For example, in this case, the protection rail 30 are held by three hold members. In FIG. 8, central axes 23*a*, 24*a*, 25*a* (reference numeral 35 in FIGS. 9(*a*)(*b*)) of hold members 23, 24, 25 comprising the constitution of FIG. 9(reference numeral 37 in FIGS. 9(*a*)(*b*)) are moved along the inside of the long slot in the direction of the gauge provided at the support member and the hold member (reference numerals 36 and 38 in FIGS. 9(*a*)(*b*)). Thus, the position of the central axes 23*a*, 24*a*, 25*a* are made so as to be identical with the imaginary central axis 26 which is a common central axis. The hold members 23, 24, 25 are turned toward the main rail 21*a* around the imaginary central axis 26 as turning center on the sleeper 27, and the protection rail 22 is made so as to be in parallel with the main rail 21*a*. In the hold members 23, 24, and 25, as shown in FIGS. 9(*a*)(*b*), the support member 34 is engaged with the hold member 37 through the bolt 41 by inserting the bolt 41 into the penetration hole 39 provided at the hold member 37 and the penetration hole 40 provided at the support member 34 and making the bolt 41 passing through the penetration holes 39, 40 (see left halves of FIGS. 9(*a*)(*b*)).

In the hold members 23, 24, and 25 of FIG. 8, the bolt 41 is loosened from the penetration holes 39 and 40 as shown in FIG. 9(*a*)(*b*), and as shown in FIG. 8, the hold members 23, 24 and 25 are turned toward the inside of the gauge around the imaginary central axis 26 which is a common central axis as turning center on the sleeper 27, and the protection rail can be easily shunted to the location 22*a* inward within the gauge (see right halves of FIGS. 9(*a*)(*b*)).

Figure 10:
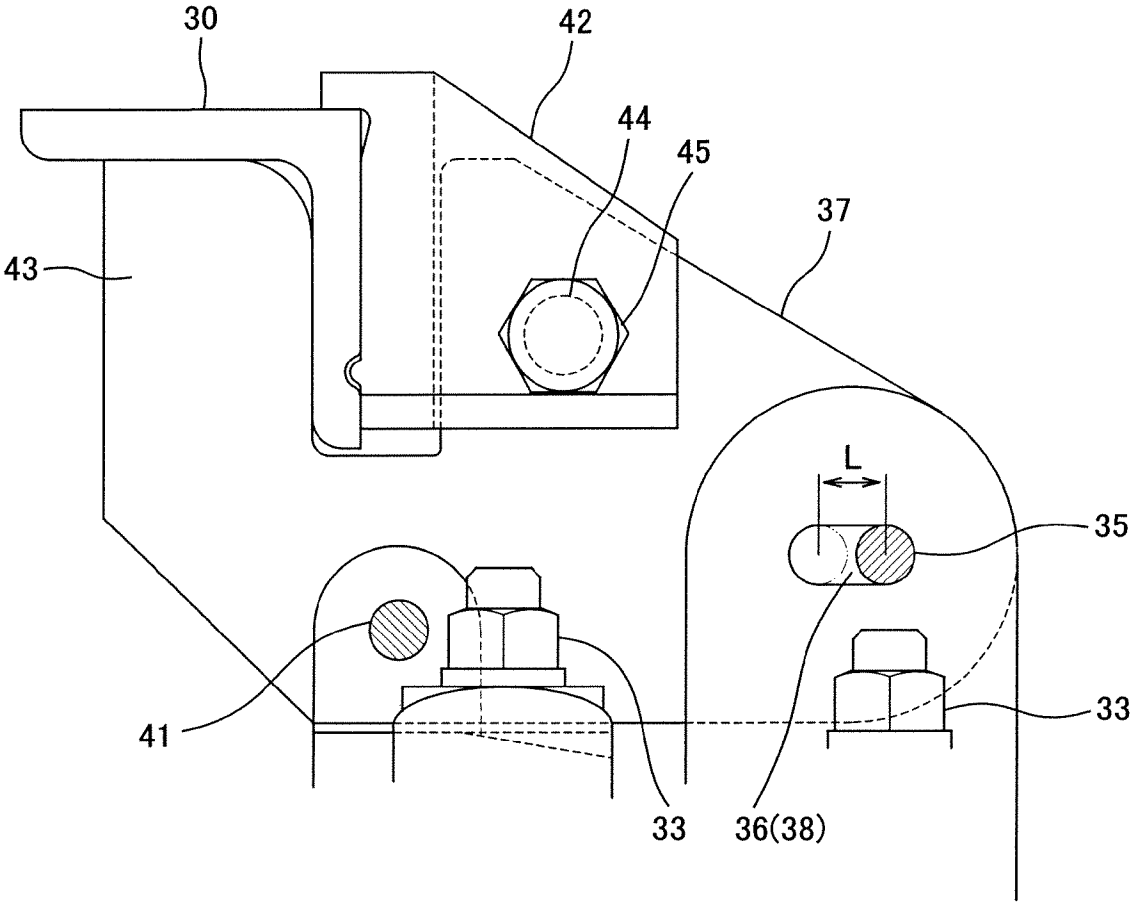
FIG. 10 is an enlarged side view showing the situation of a protection rail held by a hold member.
Figure 11:
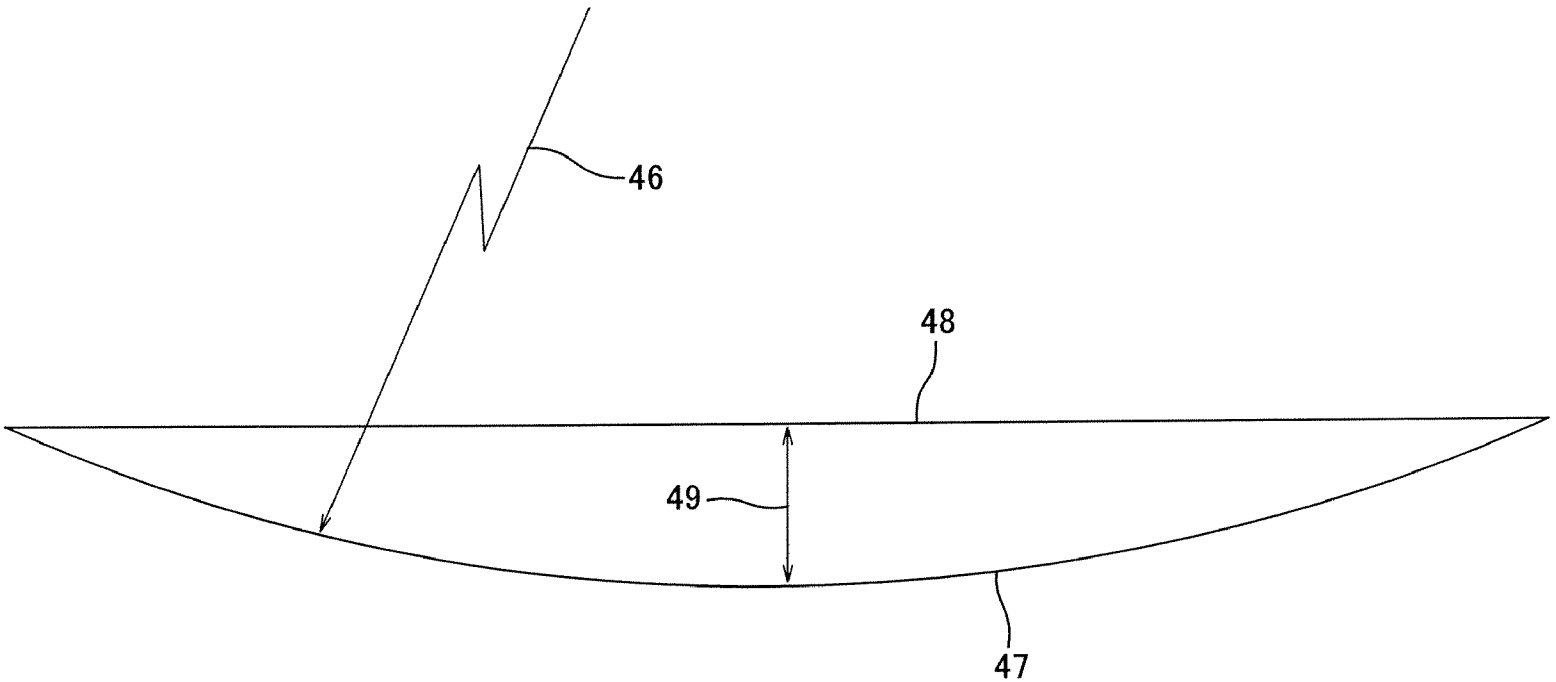
FIG. 11 is a view showing an example of curvature of a rail.

FIG. 10 is an enlarged side view showing the situation of the protection rail 30 held by hold member 37 as shown in FIG. 9(*a*). The protection rail 30 is sandwiched in between a trapezoid-shaped member 42 and a projection 43 of the hold member 37. The trapezoid-shaped member 42 is fastened to the hold member 37 by a bolt 44 and a nut 45. The main rails have various curvatures. Although not limited, for example, as shown in FIG. 11, if a radius of curvature 46 of the main rail and the protection rail is 300 meters, when the both edges of an arc 47 is connected by a chord 48 of 6 meters in length, the maximum length 49 of a perpendicular line from the arc 47 toward the chord 48 is 15 mm long. Accordingly, if the hold member 37 of FIG. 9 is used as the hold members which are provided at the protection rail whose radius of curvature is 300 meters, it is necessary that the long slot 38 provided at the hold member 37(and the long slot 36 provided at the support member 34) has at least 15 mm long as the movable length of the central axis 35. In this case, if the central axis 35 is moved along inside of the long slots 38 and 36 in the direction of the gauge, the central axis 35 of the hold member 37 can be identical with the imaginary central axis 26 which is a common central axis as shown in FIG. 8. The protection rail 30 can be held by the hold members 37 as shown in FIG. 9(*a*)(*b*) and the protection rail 30 can be turned toward the inside of the gauge around the imaginary central axis 26 as turning center.

Figure 12:
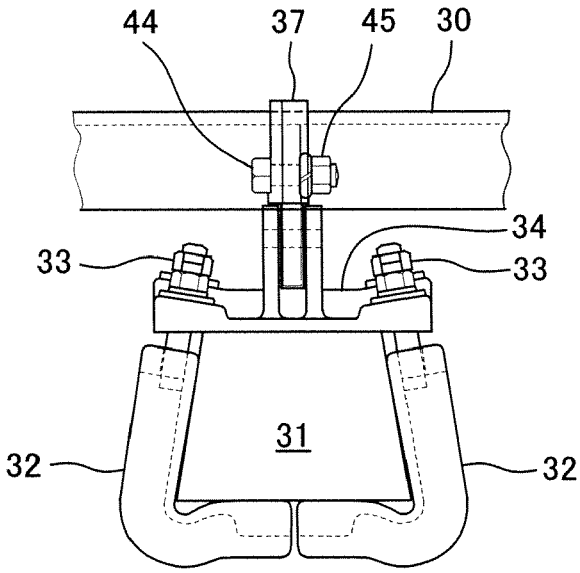
FIG. 12 is a sectional view in the direction of arrow mark XII-XII drawn in FIG. 9(*a*). The main rail and the wheel are omitted.

FIG. 12 is a sectional view in the direction of arrow mark XII-XII drawn in FIG. 9(*a*). The main rail 28 and the wheel 29 are omitted.

(The Derailment Prevention Function)

In accordance with the wheel guard device as described above, as shown in FIG. 9(*a*), if the wheel 29 of the train running on the main rail is likely to derail, the transverse movement of the wheel 29 is blocked by the protection rail 30 and the wheel 29 being likely to derail is returned to the main rail 28 so as to be attendant on the wheel running normally on the main rail 28. As a result, the wheel 29 does not derail. The protection rail which is used as the derailment prevention guard does not need the function to push positively against the wheel, being different from the guard rail which is laid along the main rail for minimizing damage from derailment, and the function as a resistance substance for suppressing the transverse movement of the wheel is enough for the derailment prevention guard.

The Second Embodiment

Figure 13:
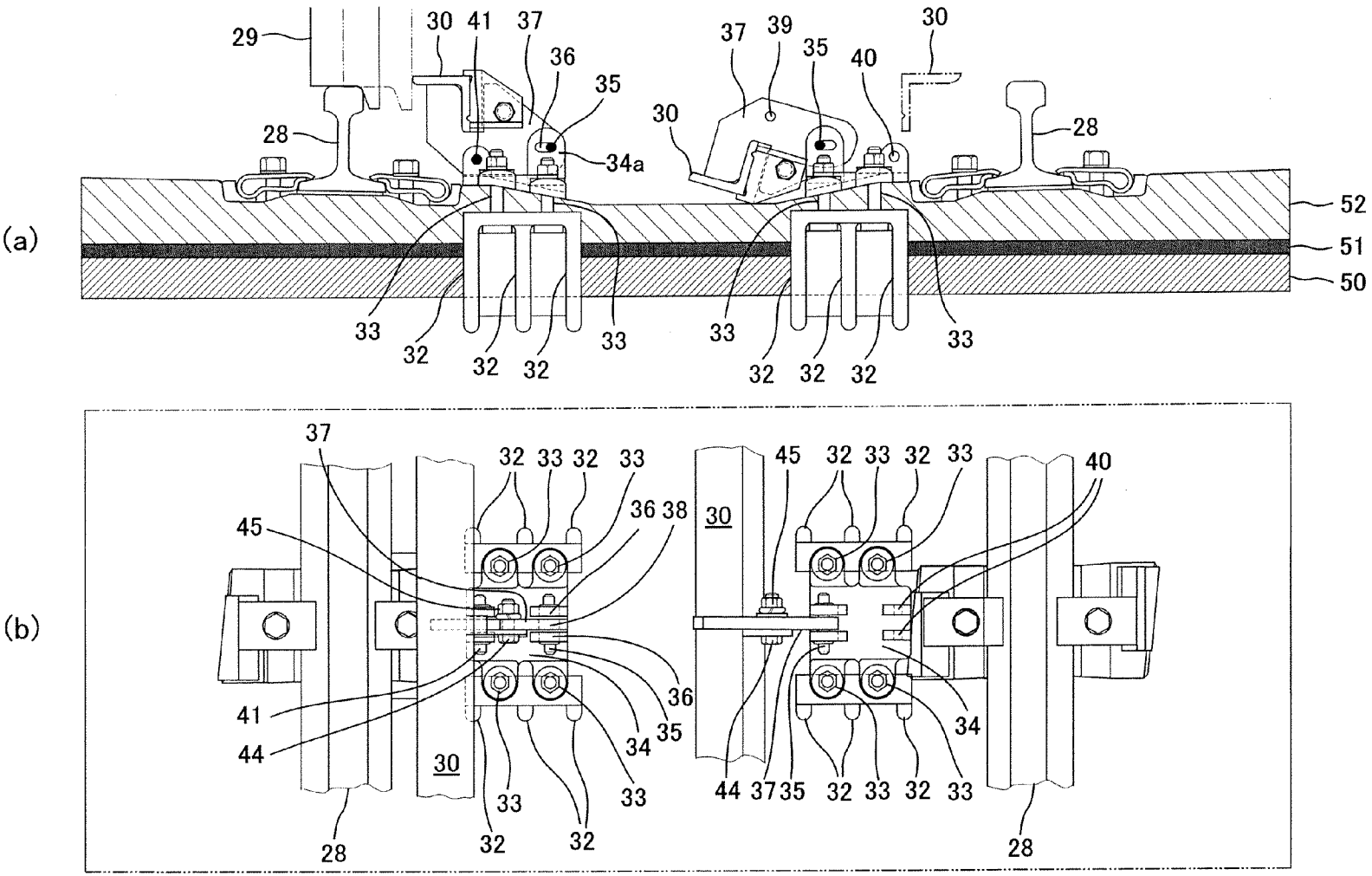
FIG. 13(*a*) is a side view including a section of the second embodiment of a structure of a derailment prevention guard of the second invention applied to a permanent way, and FIG. 13(*b*) is a plane view of FIG. 13(*a*)(the wheel is omitted).

FIG. 13(*a*) is a side view including a section of the second embodiment of a structure of a wheel guard device of the second invention as a derailment prevention guard applied to a permanent way(concrete slab track), and FIG. 13(*b*) is a plane view of FIG. 13(*a*). FIGS. 13(*a*)(*b*) is different from FIGS. 9(*a*)(*b*) in that a concrete slab track comprising a roadbed concrete 50, a cement asphalt 51 and a concrete slab 52 is used in place of the sleeper 31. The functions and effects of the constitution of FIGS. 13(*a*)(*b*) is the same as FIG. 9(*a*)(*b*). The explanation of the other members is omitted by giving the identical reference numerals as FIGS. 9(*a*)(*b*).

(Ballast Tamping Work or Rail Grinding Work Underneath Rail and the Derailment Prevention Guard of the Second Invention)

As shown in FIG. 29(*b*), the large weight from rails causes the filling density of ballast around underneath the rails to become sparsely little by little. So, before the filling density of ballast become sparsely so as to cause track sinking, as shown in FIG. 29(*a*), the ballast around underneath the rails needs to be tamped so as to become densely by a tie tamper or a multiple tie tamper. If the rail maintenance car runs on a rail and the data for evaluating the comfortable degree to ride in exceeds a standard value, the rail grinding car must grind the unevenness part of the rail. In this case, by the present invention, as shown in FIGS. 9(*a*)(*b*) or FIG. 13, if the bolt 41, which engages the support member 34 with the hold member 37, is loosened, the central axis 35 can be moved along the side of the long slots 38 and 36 in the direction of the gauge and the central axis 35 of the hold members 37 can be identical with the imaginary central axis 26 as shown in FIG. 8. Furthermore, as shown in right halves of FIG. 9(*a*) or FIG. 13(*a*), the protection rail 30 can be shunted inward within the gauge by turning the hold member 37 toward the inside of the gauge around the imaginary central axis as turning center on the sleeper 31 or the concrete slab track. Accordingly, the protection rail 30 does not interfere with the ballast tamping work underneath the main rail 28 by a tie tamper or a multiple tie tamper and the works of a rail grinding car and a rail maintenance car. It is not necessary to move the heavy protection rail to the permanent wayside outside the range of the ballast tamping work, the rail grinding work and the rail maintenance work by human power. So, there is no problem on safety.

If the protection rail 30 is used as the guard rail which is laid along the main rail for minimizing damage from derailment, the protection rail 30 is preferably laid inside the gauge nearer the center than the location as shown in FIGS. 9(*a*)(*b*) and FIGS. 13(*a*)(*b*). The protection rail 30, which is used as the guard rail, may be laid outside the gauge.

3. Embodiments of the Third Invention

The First Embodiment

Figure 14:
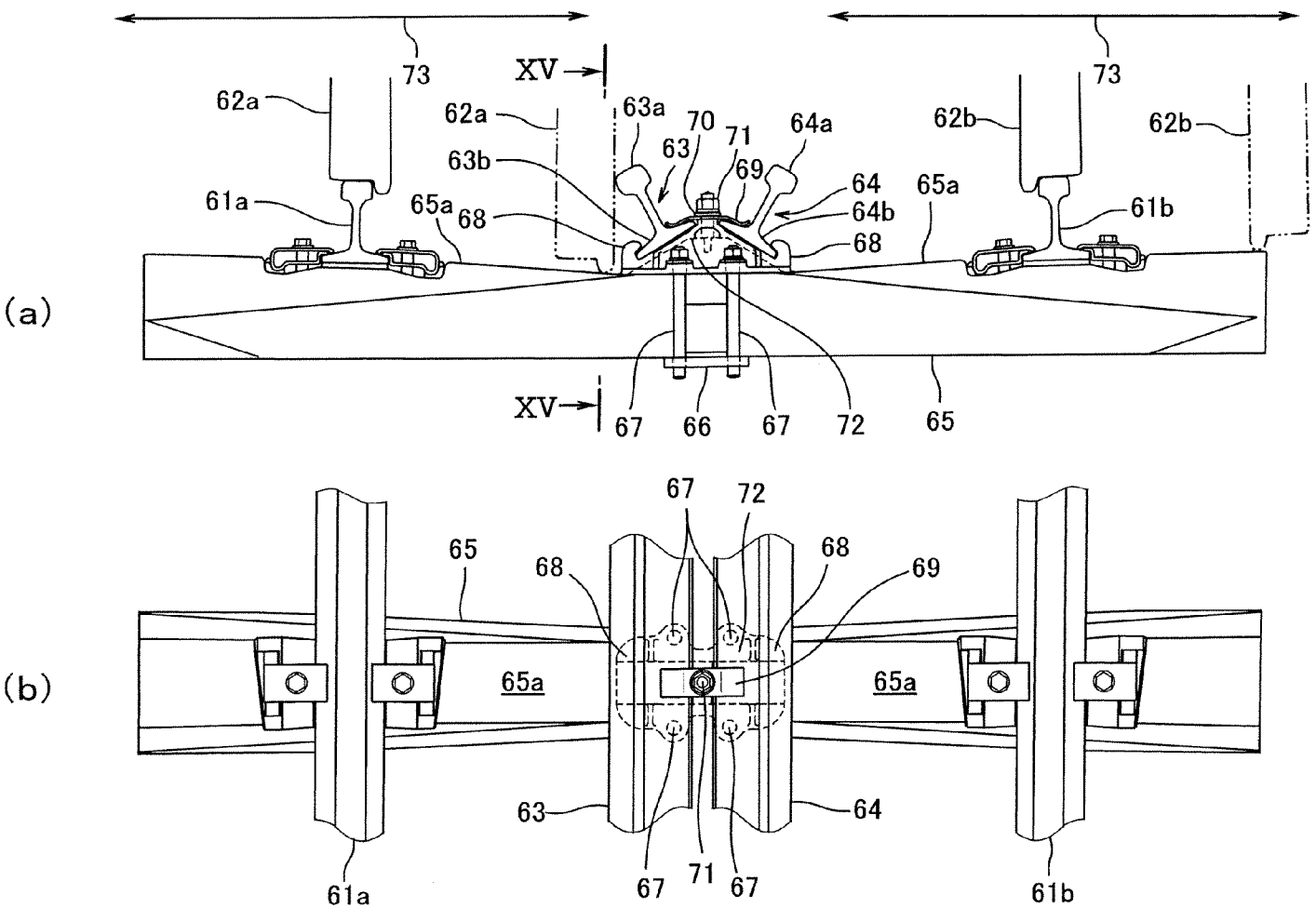
FIG. 14(*a*) is a side view of the first embodiment of a structure of a guard rail apparatus of the third invention applied to a permanent way, and FIG. 14(*b*) is a plane view of FIG. 14 (*a*)(the wheel is omitted).
Figure 15:
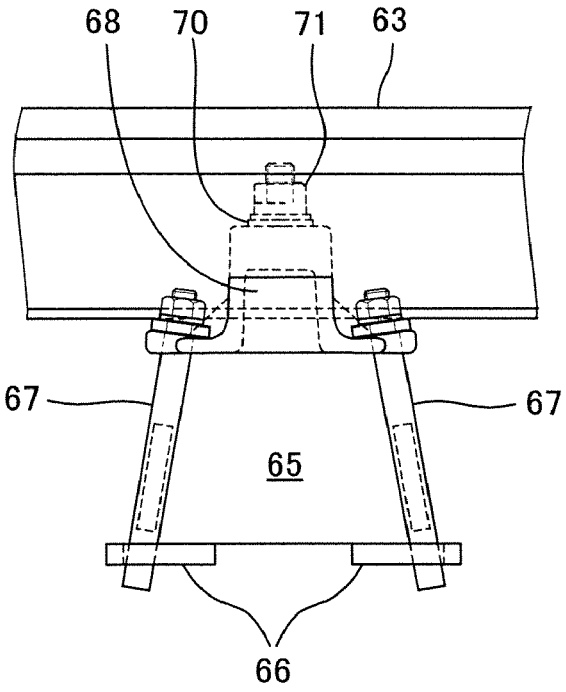
FIG. 15 is a sectional view in the direction of arrow mark XV-XV drawn in FIG. 14(*a*).

FIG. 14(*a*) is a side view of the first embodiment of a structure of a guard rail apparatus of the third invention applied to a permanent way, and FIG. 14(*b*) is a plane view of FIG. 14(*a*)(the wheel is omitted). FIG. 15 is a sectional view in the direction of arrow mark XV-XV drawn in FIG. 14(*a*).

In FIGS. 14(*a*)(*b*), references numerals 61*a* and 61*b* are main rails and references numerals 62*a* and 62*b* are wheels.

A first guard rail 63 is arranged so as to be in parallel with a main rail 61*a* so that the first guard rail 63 may face the main rail 61*a* keeping the rail head 63*a* oblique, and a second guard rail 64 is arranged so as to be in parallel with an other main rail 61*b* so that the second guard rail 64 may face the other main rail 61*b* keeping the rail head 64*a* oblique.

Reference numeral 65 is a prestressed concrete sleeper (hereinafter referred to as PC sleeper). The upper surface 65*a* of the PC sleeper 65 is slanted a little upward from the center toward the both ends. An washer 68 is fixed by tightening four bolts 67 which penetrate a flat plate 66 attached to the bottom of the PC sleeper 65. A rail base 63*b* of the first guard rail 63 and a rail base 64*b* of the second guard rail 64 are received at the recess of the washer 68. Furthermore, a washer 69 put on the rail bases 63*b*, 64*b* hold the rail bases 63*b*, 64*b* from above. A bolt 71 penetrates a member 72(fixed by the bolt 67) through a washer 70. Thus, the rail bases 63*b* and 64*b* are sandwiched in between the washer 69 and the washer 68 by tightening the bolt 71.

The range denoted by an arrow mark 73 is the range of the ballast tamping work by a tie tamper or a multiple tie tamper. In the middle of the gauge outside the range of the ballast tamping work, the first guard rail 63 is in parallel with the main rail 61*a* and the second guard rail 64 is in parallel with the main rail 61*b*.

In the accordance with the guard rail apparatus as described above, for example, as shown in FIG. 14(*a*), even if the wheels 62*a* and 62*b* of a part of the train running on the main rails 61*a* and 61*b* run off the main rails and move rightward, since the movement of the derailed wheel 62*a* is blocked by striking the slanted rail head 63*a* of the first guard rail 63, the derailed wheel 62*a* does not crush the washer 68, and further lateral movement of the wheel 62*a* is blocked. Since another wheel 62*b* is located on the PC sleeper 65, another wheel 62*b* does not run off the PC sleeper 65. Next, by bringing a hoist such as a crane to the spot and returning the derailed train to the main rail, the normal service of the train can be resumed.

It is preferable that the first guard rail 63 and the second guard rail 64 are disposed as near the center of the guard as possible so that the first guard rail 63 and the second guard rail 64 will not interfere with the ballast tamping work. On the other hand, in consideration of a space between the wheels 62*a* and 62*b*, it is preferable that the first guard rail 63 or the second guard rail 64 are disposed at the location so that the wheels 62*a* or 62*b*, which are not guided by the first guard rail 63 or the second guard rail 64, will not run off the PC sleeper 65.

In accordance with this embodiment, since there are the first guard rail 63 and the second guard rail 64 in the middle of the gauge being outside the range of the ballast tamping work, the guard rails 63 and 64 do not interfere with the ballast tamping work underneath the main rail by a tie tamper or a multiple tie tamper. It is not necessary to move the heavy guard rail to the permanent wayside being outside the range of the ballast tamping work by a tie tamper by human power. So, there is no problem on safety, and the maintenance free can be obtained.

The Second Embodiment

Figure 16:
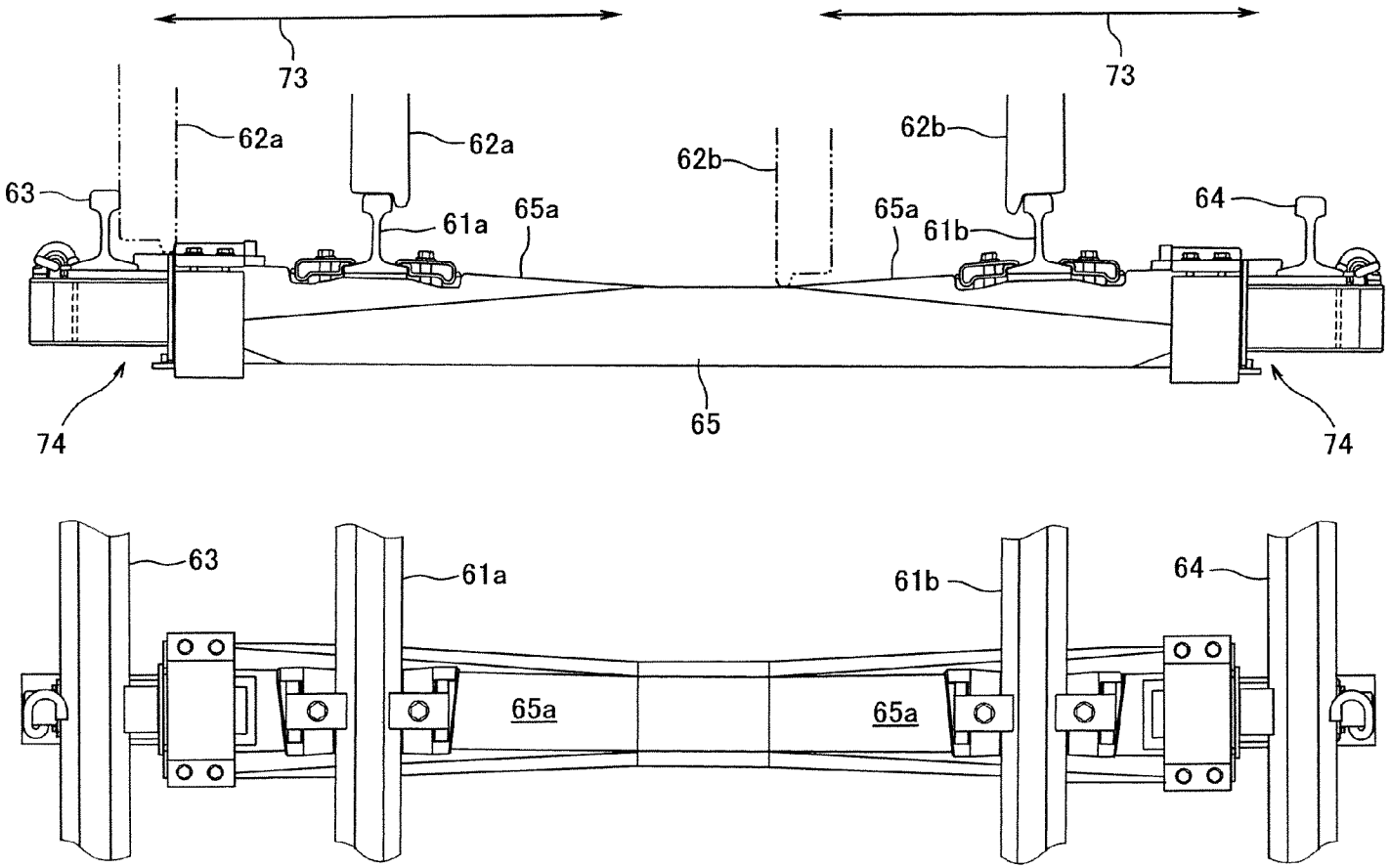
FIG. 16(*a*) is a side view of the second embodiment of a structure of a guard rail apparatus of the third invention applied to a permanent way, and FIG. 16(*b*) is a plane view of FIG. 16(*a*)(the wheel is omitted).
Figure 17:
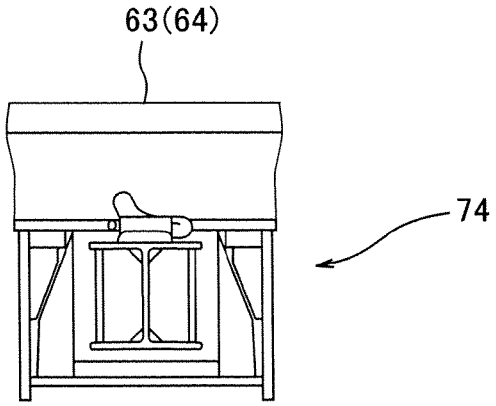
FIG. 17 is a left and right end view of FIG. 16(*a*).

FIG. 16(*a*) is a side view of the second embodiment of a structure of a guard rail apparatus of the third invention applied to a permanent way, and FIG. 16(*b*) is a plane view of FIG. 16(*a*)(the wheel is omitted). The explanation of the members which are common to the FIG. 14 and the FIG. 16 are omitted by giving the identical reference numerals as FIG. 14(*a*)(*b*). FIG. 17 is a left and right end view of FIG. 16.

In the outside of a range 73 of the ballast tamping work at one end of the PC sleeper 65, the first guard rail 63 is in parallel with the main rail 61*a*. In the outside of the range 73 of the ballast tamping work at the other end of the PC sleeper 65, the second guard rail 64 is in parallel with the main rail 61*b*.

In this embodiment, the first guard rail 63 and the second guard rail 64 are fastened to the PC sleeper 65 by a rail fastening device 74 as described below.

Figure 18:
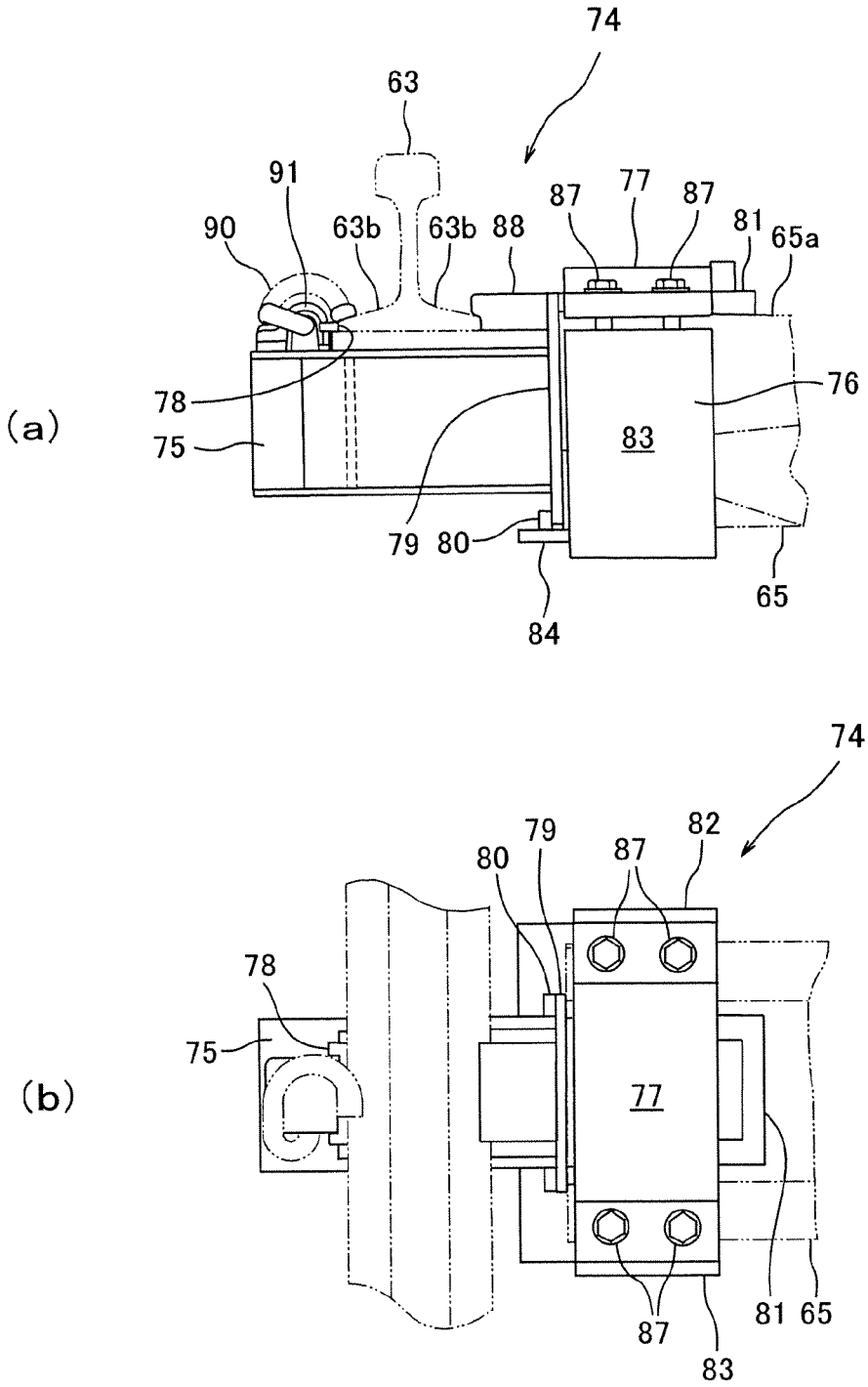
FIG. 18(*a*) is a side view of a rail fastening device 74, and FIG. 18(*b*) is a plane view of FIG. 18(*a*).

FIG. 18(*a*) is a side view of the rail fastening device 74, and FIG. 18(*b*) is a plane view of FIG. 18(*a*). The rail fastening device 74 comprises a fixed block 75, a first fixed metal fitting 76, a second fixed metal fitting 77 and a washer 78.

Figure 19:
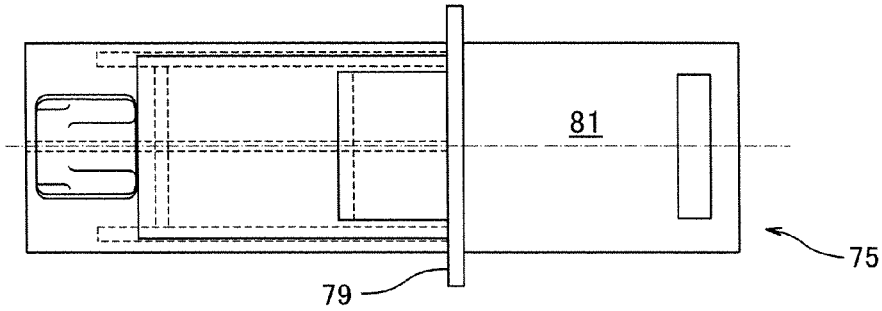
FIG. 19(*a*) is a plane view of a fixed block 75, FIG. 19(*b*) is a side view of FIG. 19(*a*), and FIG. 19(*c*) is a left end view of FIG. 19(*a*).
Figure 19:
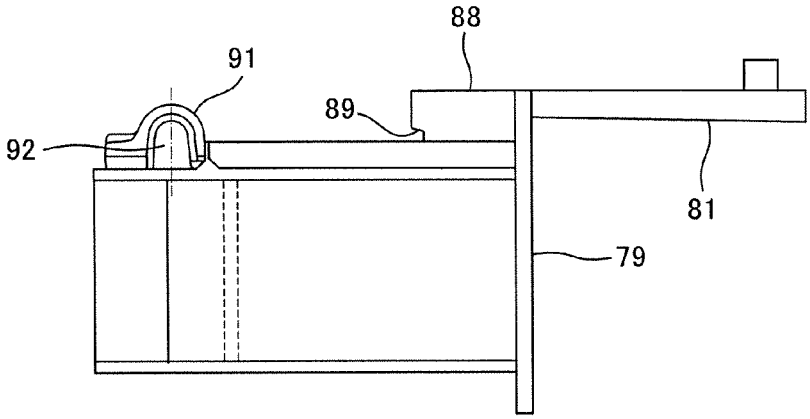
Figure 19:
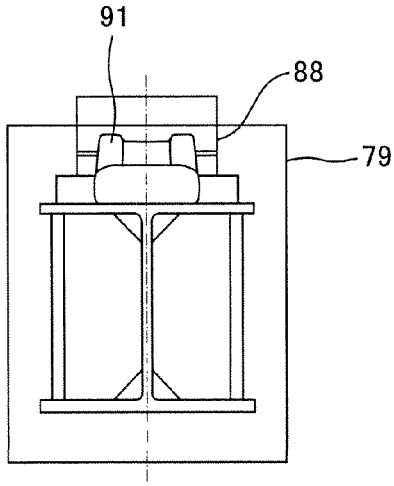

FIG. 19(*a*) is a plane view of a fixed block 75, FIG. 19(*b*) is a side view of FIG. 19(*a*), and FIG. 19(*c*) is a left end view of FIG. 19(*a*).

Figure 20:
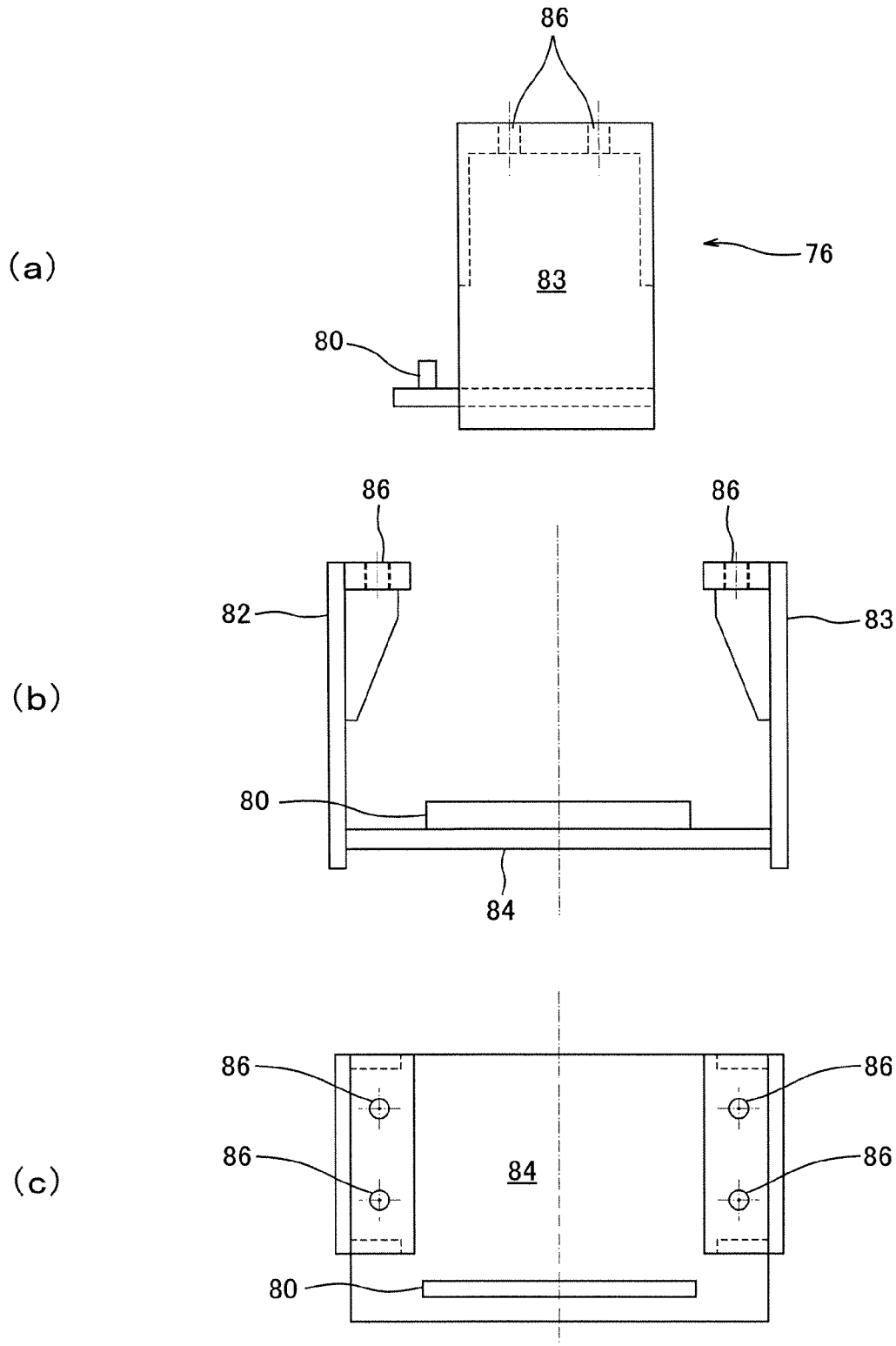
FIG. 20(*a*) is a side view of a first fixed metal fitting 76, FIG. 20(*b*) is a left end view of FIG. 20(*a*), and FIG. 20(*c*) is a plane view of a first fixed metal fitting 76.

FIG. 20(*a*) is a side view of a first fixed metal fitting 76, FIG. 20(*b*) is a left end view of FIG. 20(*a*), and FIG. 20(*c*) is a plane view of the first fixed metal fitting 76.

Figure 21:
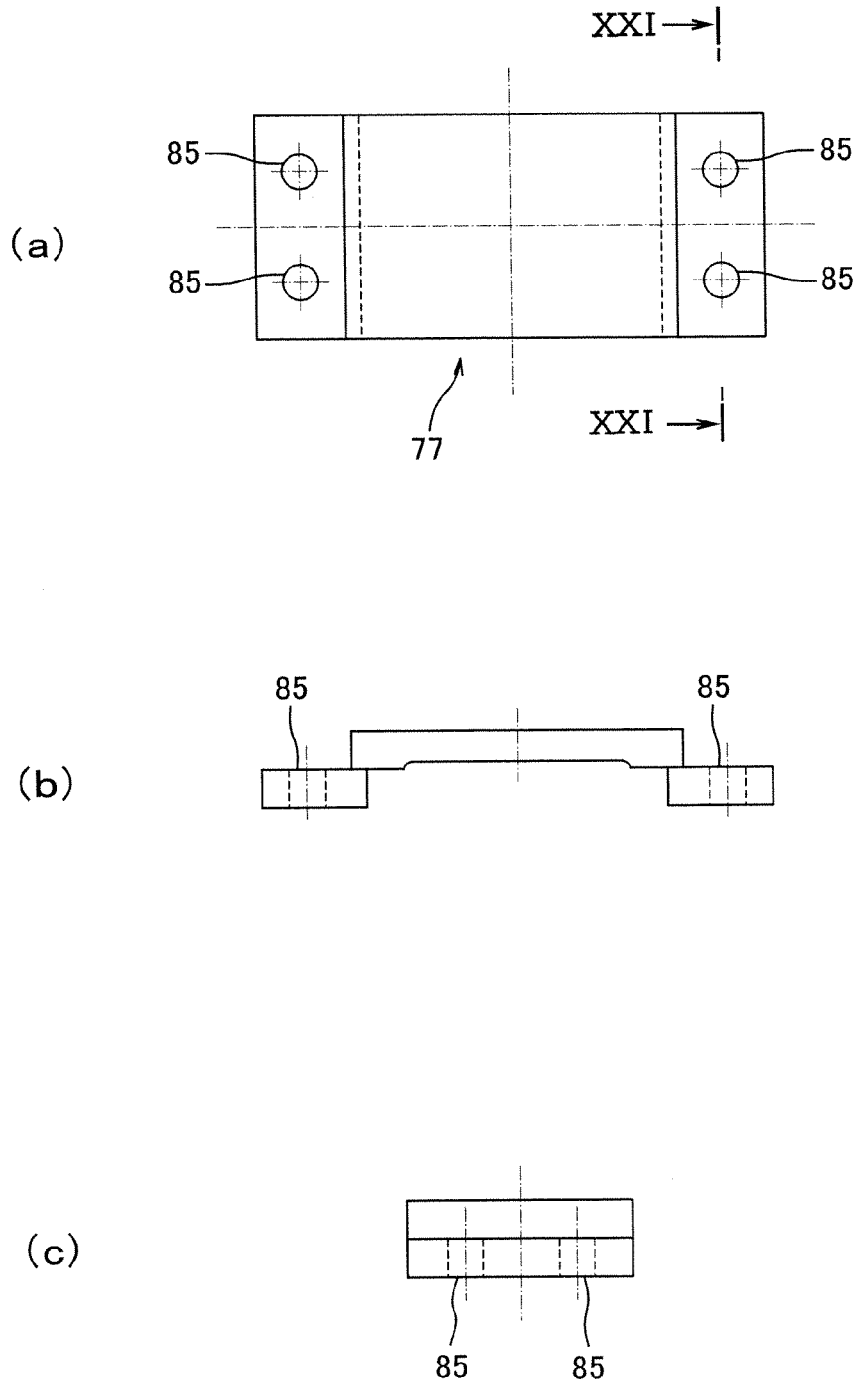
FIG. 21(*a*) is a plane view of a second fixed metal fitting 77, FIG. 21(*b*) is a side view of FIG. 21(*a*), and FIG. 21(*c*) is a sectional view in the direction of arrow mark XXI-XXI drawn in FIG. 21(*a*).

FIG. 21(*a*) is a plane view of a second fixed metal fitting 77, FIG. 21(*b*) is a side view of FIG. 21(*a*), and FIG. 21(*c*) is a sectional view in the direction of arrow mark XXI-XXI drawn in FIG. 21(*a*).

Figure 22:
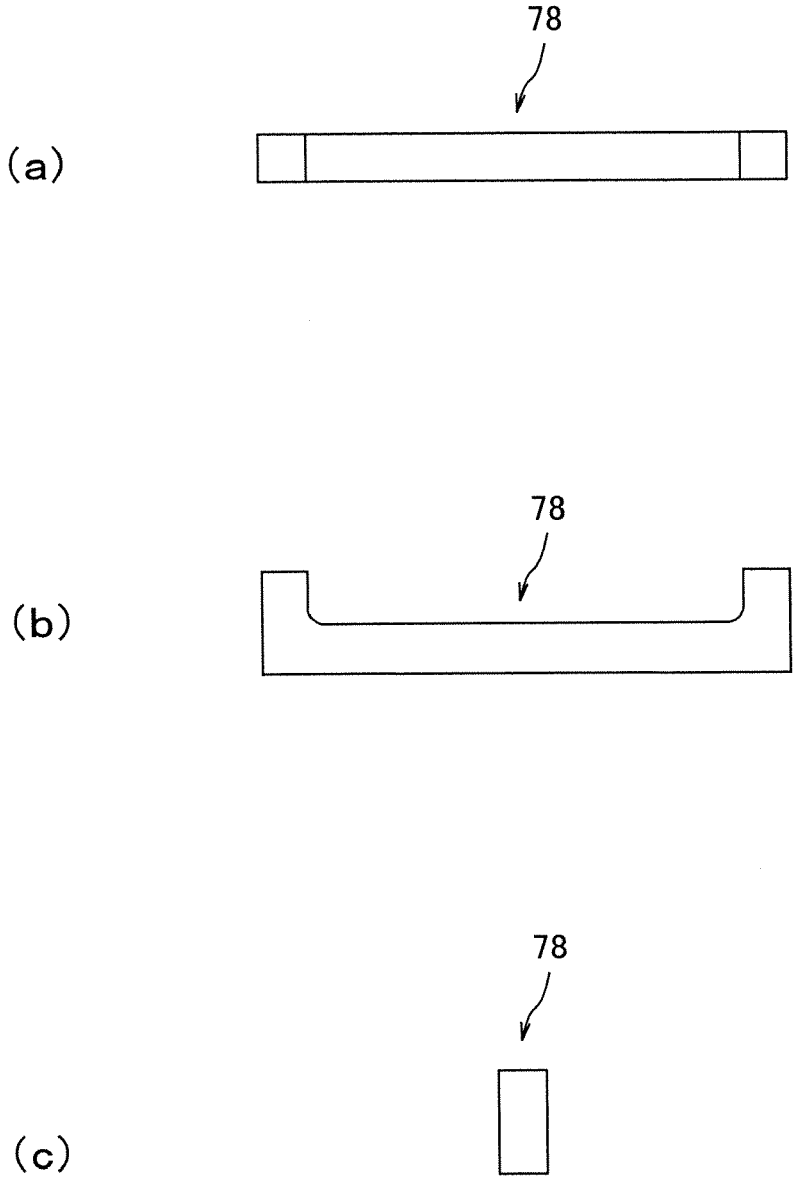
FIG. 22(*a*) is a plane view of a washer 78, FIG. 22(*b*) is a side view of FIG. 22(*a*), and FIG. 22(*c*) is a left and right end view of FIG. 22(*a*).

FIG. 22(*a*) is a plane view of a washer 78, FIG. 22(*b*) is a side view of FIG. 22(*a*), and FIG. 22(*c*) is a left and right end view of FIG. 22(*a*).

The guard rails 63 and 64 shown in FIGS. 16(*a*)(*b*) can be fastened to the PC sleeper 65 as described below by using the above rail fastening device.

The fixed block 75 is installed so that a plate-shaped member 79 of the fixed block 75 shown in FIG. 19 may be able to come into contact with one edge surface of the PC sleeper 65 shown in FIG. 18(*a*). The first fixed metal fitting 76 is installed so that the plate-shaped member 79 of the fixed block 75 may be received in a gap between a projection 80 of the first fixed metal fitting 76 shown in FIG. 20 and one end surface of the PC sleeper 65 shown in FIG. 18(*a*). As shown in FIGS. 19(*a*)(*b*), the fixed block 75 comprises a pseudowedge-shaped projection 81 along the slope of the upper surface 65*a* of the PC sleeper 65 shown in FIG. 18(*a*). The first fixed metal fitting 76 shown in FIGS. 20(*a*)(*b*)(*c*) comprises aloft side member 82, aright side member 83 and a bottom member 84. The pseudowedge-shaped projection 81 of the fixed block 75 shown in FIG. 19 is touched to the slope of the upper surface 65*a* of the PC sleeper 65 shown in FIG. 18(*a*). The bottom member 84 of the first fixed metal fitting 76 shown in FIG. 20(*b*)(*c*) is touched to the lower surface of the PC sleeper 65 shown in FIG. 18(*a*). The both sides of the PC sleeper 65 shown in FIG. 18(*b*) are covered with the left side member 82 and the right side member 83 of the first fixed metal fitting 76 shown in FIGS. 20(*a*)(*b*). The pseudowedge-shaped projection 81 of the fixed block 75 shown in FIG. 18(*a*) is pushed down by the second fixed metal fitting 77 shown in FIG. 21(*a*). As shown in FIGS. 18 (*a*)(*b*), four bolts 87 are inserted into four bolt holes 85 provided at the second fixed metal fitting 77 shown in FIG. 21(*a*) and four bolt holes 86 provided at the first fixed metal fitting 76 shown in FIG. 20(*c*), and the four bolts 87 are passed through the bolt holes 85, 86 and the above bolts 87 are tightened. As described above, the rail fastening device 74 is fastened to the PC sleeper 65.

On the other hand, the first guard rail 63 and the second guard rail 64 shown in FIGS. 16(*a*)(*b*) can be fastened to the rail fastening device 74 as described below.

In FIG. 18(*a*), one end of the rail base 63*b* of the first guard rail 63 is received at a recess 89 of a member 88 of the fixed block 75(see FIG. 19(*b*)). One end of a wire spring clip 90 is inserted into an opening 92 of a receiving metal fitting 91 of the fixed block 75(see FIG. 19(*b*)). The other end of the rail base 63*b* of the first guard rail 63 is pushed down by the other end of the wire spring clip 90. The rail base of the guard rail can be fastened by the bolt and the washer in place of the wire spring clip.

As described above, in accordance with this embodiment, it is possible to fasten the guard rails 63 or 64 to the PC sleeper 65 by the rail fastening device 74 without processing the present PC sleeper 65.

As shown in FIG. 18(*a*), the pseudowedge-shaped projection 81 along the slope of the upper surface 65*a* of the PC sleeper 65 is touched just to the upper surface 65*a* of the PC sleeper 65, and the bottom member 84 of the first fixed metal fitting 76 is touched to the lower surface of the PC sleeper 65. The pseudowedge-shaped projection 81 is put between the first fixed metal fitting 76 and the second fixed metal fitting 77, and the PC sleeper 65 is fastened so as to be just wrapped in the fixed block 75 and the first fixed metal fitting 76 and the second fixed metal fitting 77. As a result, the rail fastening device 74 is hard to release from the PC sleeper 65. Even if the PC sleeper 65 moves up and down at the passing of the train, the plate-shaped member 79 of the fixed block 75 is received in a gap between a projection 80 of the first fixed metal fitting 76 and the end surface of the PC sleeper 65. Thus, the fixed block 75, the first fixed metal fitting 76 and the PC sleeper 65 make a movement so as to be just incorporated in one structure and it is possible to minimize clattering of the rail fastening device 74.

In the accordance with the guard rail apparatus as described above, for example as shown in FIG. 16(*a*), even if the wheels 62*a* and 62*b* of a part of the train running on the main rails 61*a* and 61*b* run off the main rails and move leftward, since the derailed wheel 62*a* is guided by the guard rail 63, and further lateral movement of the wheel 62*a* is blocked and the wheel 62*a* does not run off the PC sleeper 65. Next, by bringing a hoist such as a crane to the spot and returning the derailed train to the main rail, the normal service of the train can be resumed.

In accordance with this embodiment, as shown in FIG. 16(*a*), since there are the first guard rail 63 and the second guard rail 64 in the outside the range 73 of the ballast tamping work at the end of the sleeper, the guard rails 63 and 64 do not interfere with the ballast tamping work underneath the main rail by a tie tamper or a multiple tie tamper. It is not necessary to move the heavy guard rail to the permanent wayside being outside the range of the ballast tamping work by a tie tamper by human power. So, there is no problem on safety, and the maintenance free can be obtained.

The Third Embodiment

Figure 23:
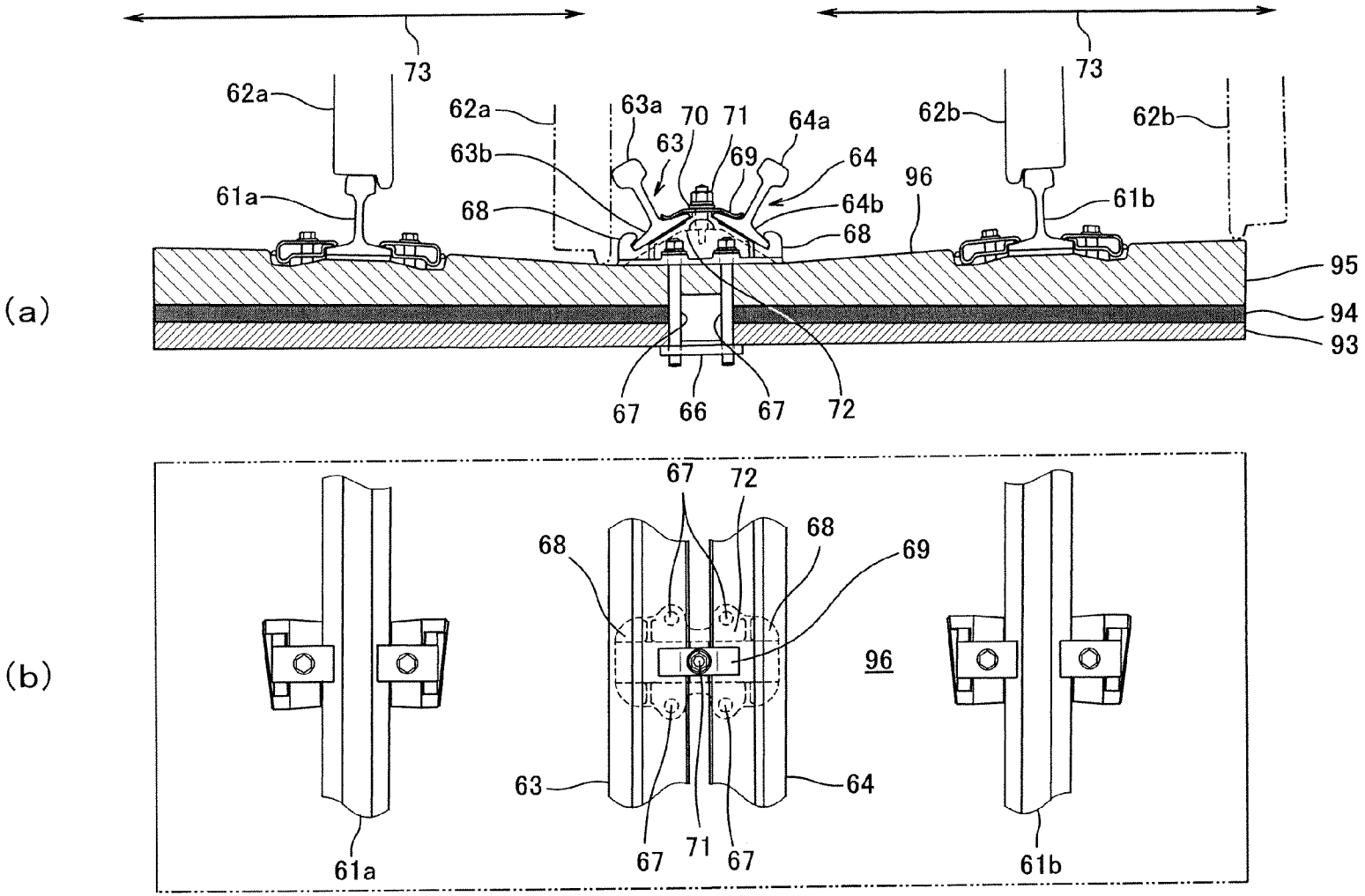
FIG. 23(*a*) is a side view including a section of the third embodiment of a structure of a guard rail apparatus of the third invention applied to a permanent way, and FIG. 23(*b*) is a plane view of FIG. 23(*a*)(the wheel is omitted).

FIG. 23(*a*) is a side view including a section of the third embodiment of a structure of a guard rail apparatus of the third invention applied to a permanent way, and FIG. 23(*b*) is a plane view of FIG. 23(*a*)(the wheel is omitted). FIGS. 23(*a*)(*b*) are different from FIG. 14 in that a concrete slab track comprising a roadbed concrete 93, a cement asphalt 94 and a concrete slab 95 is used in place of the PC sleeper 65. The functions and effects of the constitution of this embodiment is the same as the first embodiment. The explanation of the other members is omitted by giving the identical reference numerals as FIG. 14(*a*)(*b*). The upper surface 96 of the concrete slab track is slanted a little upward from the center toward the both ends.

The Fourth Embodiment

Figure 24:
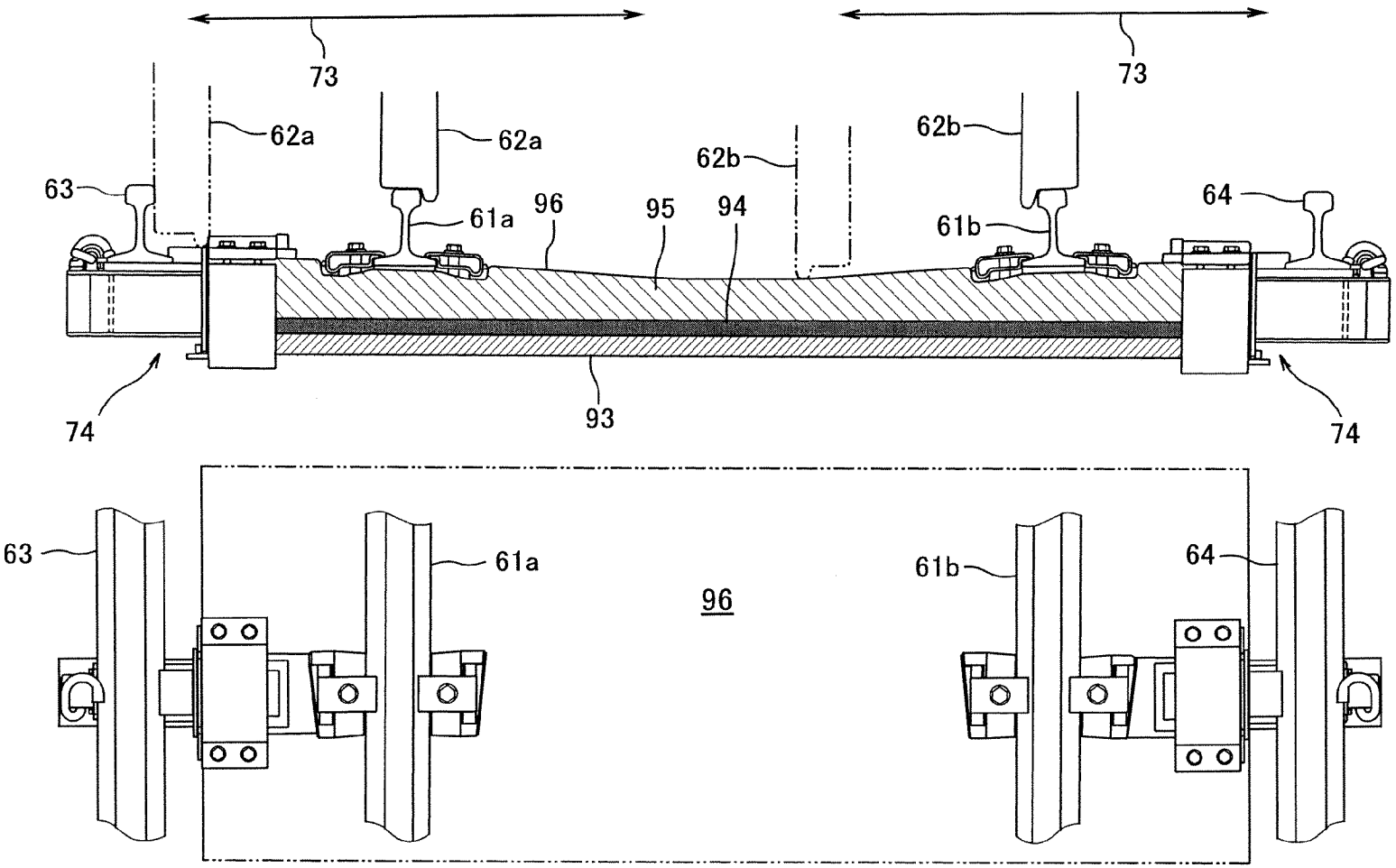
FIG. 24(*a*) is a side view including a section of the fourth embodiment of a structure of a guard rail apparatus of the third invention applied to a permanent way, and FIG. 24(*b*) is a plane view of FIG. 24(*a*)(the wheel is omitted).

FIG. 24(*a*) is a side view including a section of the fourth embodiment of a structure of a guard rail apparatus of the third invention applied to a permanent way, and FIG. 24(*b*) is a plane view of FIG. 24(*a*)(the wheel is omitted). FIGS. 24(*a*)(*b*) are different from FIG. 16 in that a concrete slab track comprising a roadbed concrete 93, a cement asphalt 94 and a concrete slab 95 is used in place of the PC sleeper 65. The functions and effects of the constitution of this embodiment is the same as the second embodiment. The explanation of the other members is omitted by giving the identical reference numerals as FIG. 16(*a*)(*b*). The upper surface 96 of the concrete slab track is slanted a little upward from the center toward the both ends.

The Fifth Embodiment

Figure 25:
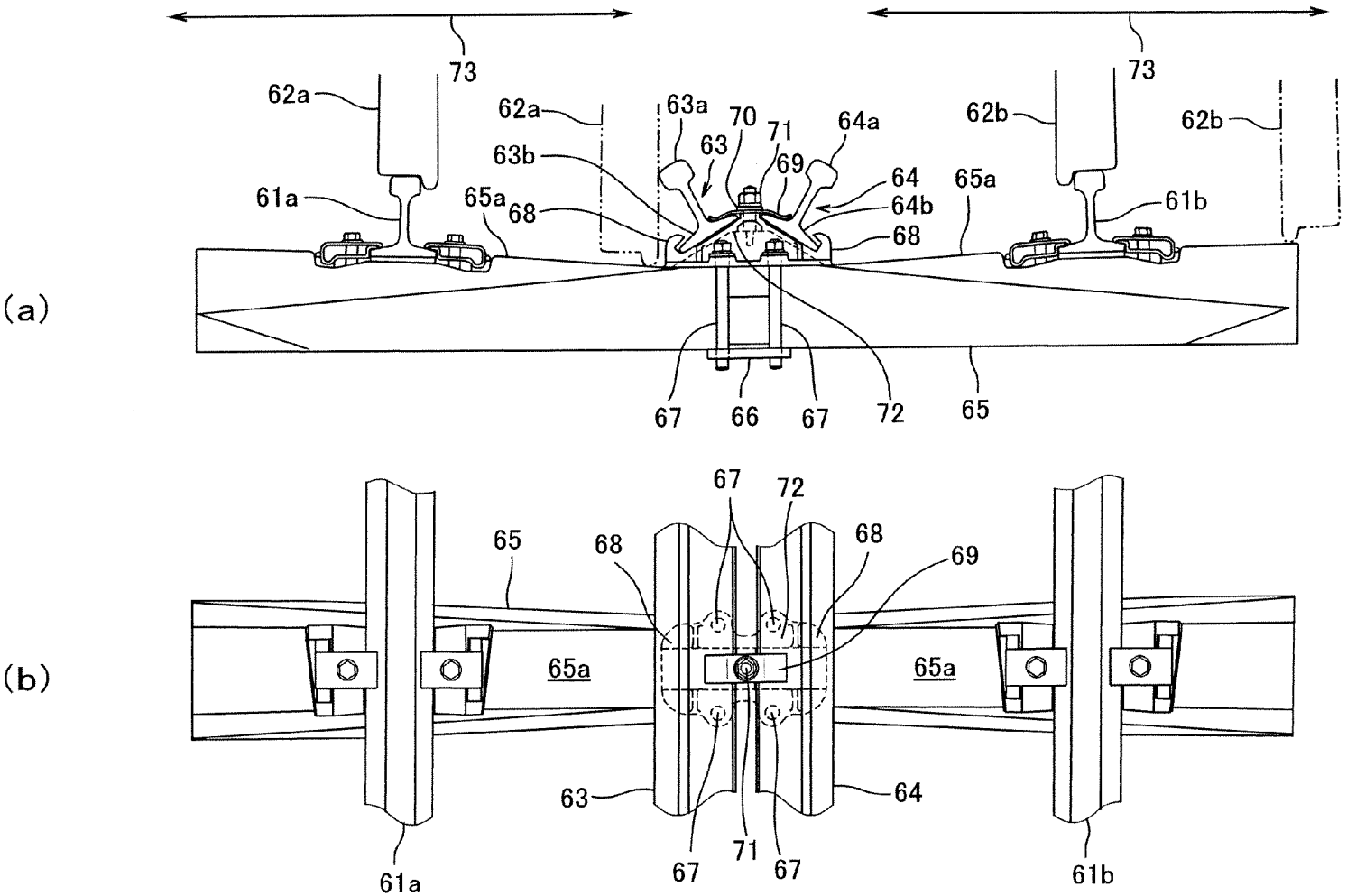
FIG. 25(*a*) is a side view of the fifth embodiment of a structure of a guard rail apparatus of the third invention applied to a permanent way, and FIG. 25(*b*) is a plane view of FIG. 25(*a*)(the wheel is omitted).
Figure 26:
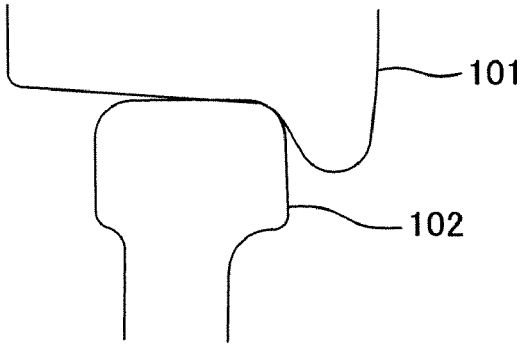
FIG. 26 is a view showing an ordinary location between a rail and a wheel.
Figure 27:
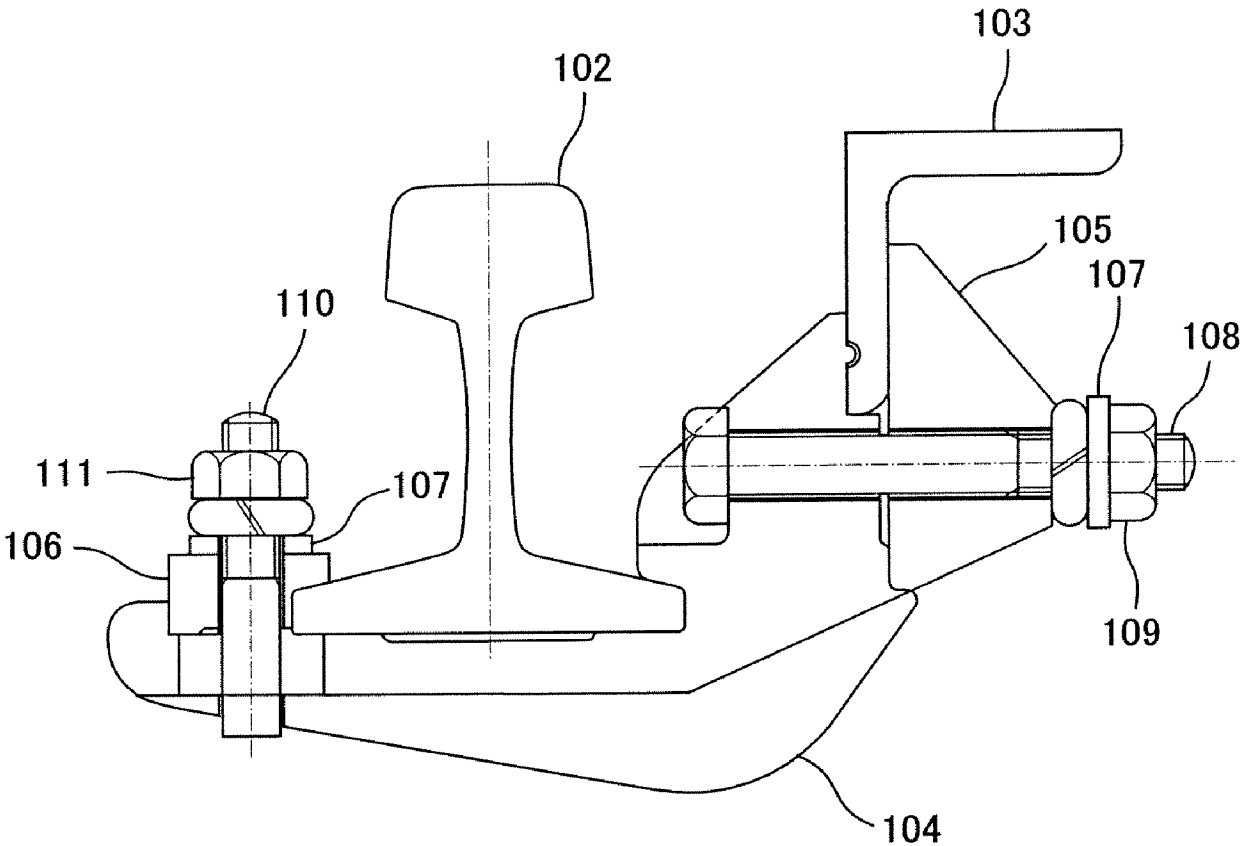
FIG. 27 is a front view of a traditional derailment prevention guard.
Figure 28:
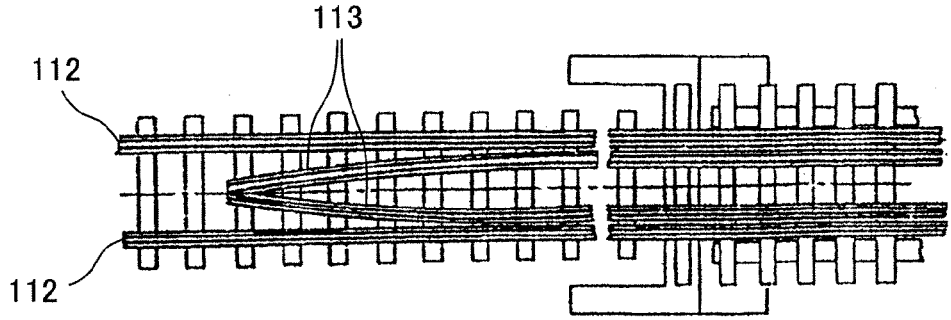
FIGS. 28(*a*) and (*b*) are plane views showing an example of the arrangement of a main rail and a guard rail.
Figure 28:
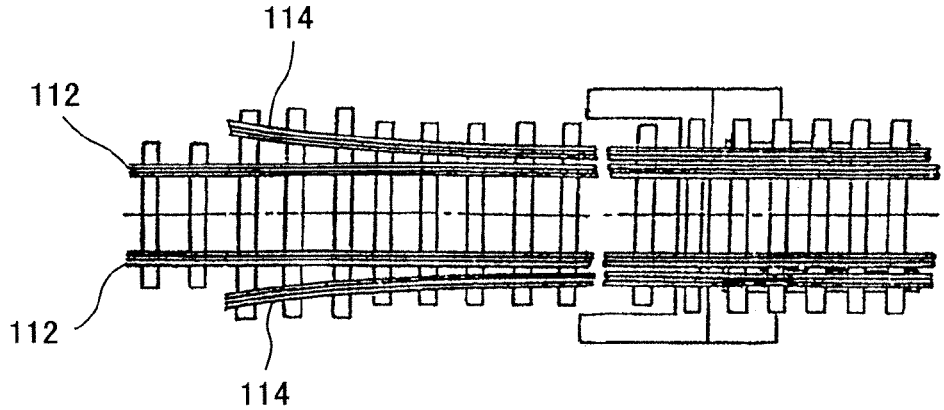

FIG. 25(*a*) is a side view of the fifth embodiment of a structure of a guard rail apparatus of the third invention applied to a permanent way, and FIG. 25(*b*) is a plane view of FIG. 25(*a*)(the wheel is omitted). FIGS. 25(*a*)(*b*) are different from FIGS. 14(*a*)(*b*) in that there is a little gap between the washer 68 and the rail bases 63*b*, 64*b* and the material of the washer 69 is carbon steel oil tempered wire for mechanical springs(SWO-A). The first guard rail 63 and the second guard rail 64 correspond to the strong beams. The rail base 63*b* and the rail base 64*b* are received at the recess of the washer 68. Furthermore, the washer 69 hold the rail bases 63*b* and 64*b* from above. The washer 68 is fixed to the PC sleeper 65 by tightening the bolt 67, and the washer 69 is fixed to the member 72 by tightening the bolt 71. When the train runs on the main rails 61*a* and 61*b*, the both ends of the PC sleeper 65 is likely to subside a little with the spot of the first guard rail 63 and the second guard rail 64 and its surrounding spot as fulcrum due to the large weight from the train. If the both ends of the PC sleeper 65 subsides repeatedly, the crack is formed at the PC sleeper 65 or the PC sleeper 65 is likely to be broken.

So, if the material of the washer 69 is the steel for mechanical springs and there is a little gap between the washer 68 and the rail bases 63*b*, 64*b*, the washer 69 makes a motion so as to lighten a part of the weight added to the PC sleeper 65 as a shock absorber when the train runs on the main rails 61*a* and 61*b*. The vertical movement of the rail bases 63*b* and 64*b* accompanied by the motion of the washer 69 is received at the gap between the washer 68 and the rail bases 63*b*, 64. Accordingly, when the train runs on the main rails 61*a* and 61*b*, even if the whole of the PC sleeper 65 may subside a little, the subsidence of only both ends of the PC sleeper 65 can be avoided.

Silicon-maganese steel oil tempered wire for mechanical springs or Silicon-chromium steel oil tempered wire for mechanical springs can be used as the material of the washer 69.

INDUSTRIAL APPLICABILITY

The present invention is suitable for the device for guiding a wheel against running off main rail and the device for preventing a derailed train from running away outside the track.

The invention claimed is:

1. A derailment prevention guard comprises a guard member installed within a gauge and a support member fixed to a sleeper or a concrete slab track, wherein the guard member is held by a hold member which can turn around a central axis supported by the support member as turning center between a main rail and the inside of the gauge on the sleeper or the concrete slab track, and the support member is engaged with the hold member by means of an engaging member through turning the hold member toward the main rail around the central axis as turning center on the sleeper or the concrete slab track, and the guard member can be shunted inward within the gauge by turning the hold member toward the inside of the gauge around the central axis as turning center on the sleeper or the concrete slab track after disengagement of the engaging member;

wherein the hold member is provided with a wire spring as freely engaging and disengaging hold means for holding the guard member; and wherein the wire spring comprises a first straight connecting portion extending from a first hook-shaped portion at one end and a second straight connecting portion extending from a second ok-shaped portion at the other end, and the first straight connecting portion is approximately in parallel with the second straight connecting portion in sight of plane, and both the first straight connecting portion and the second straight connecting portion are connected to a straight pushing down portion via a connecting portion looking like the Japanese cursive character "<", and the connecting portion looking like the Japanese cursive character "<" comprises an outward obliquely upward extending lower portion looking like the Japanese cursive character "<" and an inward obliquely upward extending upper portion looking like the Japanese cursive character "<", and both lower portions looking like the Japanese cursive character "<" are connected to the first and second straight connecting portions, and both upper portions looking like the Japanese cursive character "<" are connected to the straight pushing down portion.

2. A derailment prevention guard comprising:

a support member arranged for fixed attachment to a sleeper or a concrete slab track inside of a railway gauge;

a holding member coupled to the support member at a pivot axis, the holding member shiftable about the pivot axis between a first position in which the holding member is positioned toward a first rail of the railway gauge, and a second position in which the holding member is positioned further away from the first rail and further inside of the railway gauge;

a derailment guard member operatively coupled to the holding member, the derailment guard member and the holding member sized to position the derailment guard member to block lateral movement of a wheel toward the inside of the railway gauge;

an engagement member arranged to engage the holding member and the support member to operatively fix the holding member in the first position, the engagement member further arranged to release the holding member from the support member to permit the holding member to shift to the second position; and wherein the derailment guard member is attached to the holding member by a releasable wire spring;

and further wherein the wire spring comprises a straight portion arranged for placement on the outward side of the holding member to operatively engage the derailment guard member, a pair of hook-shaped portions arranged to engage an inward side of the holding member, and a pair of connecting portions extending between the straight portion and the hook-shaped portions.

3. The derailment prevention guard of claim 2, wherein an outward portion of each of the connecting portions includes a shaped portion shaped like the Japanese cursive character "<".

4. The derailment prevention guard of claim 2, wherein the straight portion transitions to a pair of shaped portions shaped like the Japanese cursive character "<".

5. The derailment prevention guard of claim 2, wherein the derailment guard member is attached to the holding member by a releasable wire spring, and wherein the holding member includes a pair of projections positioned to abut the wire spring, and further wherein the wire spring includes a straight outer portion coupled to the derailment guard by a trapezoid-shaped member.

6. The derailment prevention guard of claim 2, wherein the engagement member comprises a bolt positioned to engage the support member and the holding member when the holding member is in the first position.

* * * * *